US010437185B2

(12) United States Patent
Yamaguchi et al.

(10) Patent No.: US 10,437,185 B2
(45) Date of Patent: Oct. 8, 2019

(54) IMAGE HEATING APPARATUS AND IMAGE FORMING APPARATUS THAT CONTROL A TEMPERATURE AT WHICH ENERGIZATION TO A HEATER IS TURNED OFF BASED ON A TEMPERATURE RISE RATE PER UNIT TIME OF A DETECTION TEMPERATURE

(71) Applicant: CANON KABUSHIKI KAISHA, Tokyo (JP)

(72) Inventors: Yusuke Yamaguchi, Nagareyama (JP); Masayuki Tamaki, Abiko (JP); Hiroki Kawai, Abiko (JP); Ikuo Nakamoto, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/988,454

(22) Filed: May 24, 2018

(65) Prior Publication Data

US 2018/0348681 A1 Dec. 6, 2018

(30) Foreign Application Priority Data

May 30, 2017 (JP) ..... 2017-106381
Apr. 16, 2018 (JP) ..... 2018-078305

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/5004* (2013.01)

(58) Field of Classification Search
CPC ..... G03G 15/2039; G03G 15/2046; G03G 15/2042; G03G 15/703
USPC ..... 399/69
See application file for complete search history.

(56) References Cited

U.S. PATENT DOCUMENTS

| | | | |
|---|---|---|---|
| 8,554,097 | B2 | 10/2013 | Hara et al. |
| 8,712,271 | B2 | 4/2014 | Nakayama et al. |
| 8,917,999 | B2 | 12/2014 | Takada et al. |
| 8,918,003 | B2 | 12/2014 | Kawai et al. |
| 8,929,762 | B2 | 1/2015 | Shinagawa et al. |
| 8,989,640 | B2 | 3/2015 | Kitagawa et al. |
| 9,291,958 | B2 | 3/2016 | Nakamoto et al. |
| 9,329,557 | B2 | 5/2016 | Kitagawa et al. |
| 9,392,642 | B2 | 7/2016 | Tanaka et al. |

(Continued)

FOREIGN PATENT DOCUMENTS

| | | | |
|---|---|---|---|
| JP | 2000206826 A | * | 7/2000 |
| JP | 2002296962 A | | 10/2002 |

*Primary Examiner* — Walter L Lindsay, Jr.
*Assistant Examiner* — Arlene Heredia
(74) *Attorney, Agent, or Firm* — Venable LLP

(57) ABSTRACT

An image heating apparatus includes a controller configured to control a temperature at which energization to a heater is turned off, depending on a detection temperature of a detecting portion, wherein, when a temperature rise rate per unit time of the detection temperature of the detecting portion is a first rise rate, the controller turns off the energization to the heater in response to the detection temperature reaching a first temperature, and, when the temperature rise rate per unit time is a second rise rate that is less than the first rise rate, the controller turns off the energization to the heater in response to the detection temperature reaching a second temperature that is greater than the first temperature.

15 Claims, 15 Drawing Sheets

(56) References Cited

U.S. PATENT DOCUMENTS

| | | | | |
|---|---|---|---|---|
| 9,977,385 | B2 | 5/2018 | Miura et al. | |
| 2013/0142532 | A1 | 6/2013 | Kitagawa et al. | |
| 2017/0146934 | A1* | 5/2017 | Kaji ..... | G03G 15/2025 |

* cited by examiner

IMAGE HEATING APPARATUS AND IMAGE FORMING APPARATUS THAT CONTROL A TEMPERATURE AT WHICH ENERGIZATION TO A HEATER IS TURNED OFF BASED ON A TEMPERATURE RISE RATE PER UNIT TIME OF A DETECTION TEMPERATURE

This application claims the benefit of Japanese Patent Application No. 2017-106381, filed on May 30, 2017, and Japanese Patent Application No. 2018-078305, filed on Apr. 16, 2018, which are incorporated by reference herein in their entireties.

FIELD OF THE INVENTION AND RELATED ART

The present invention relates to an image heating apparatus (fixing device) for heating a toner image on a recording material, and relates to an image forming apparatus. The image heating apparatus is suitably usable by being mounted in the image forming apparatus of an electrophotographic type, or the like.

In the image forming apparatus of the electrophotographic type, an unfixed toner image is formed on a recording material. Then, the recording material on which the toner image is formed is fed to a fixing device (image heating apparatus). In the fixing device, heat and pressure are applied to the unfixed toner image at a fixing nip, so that the toner image is fixed on the recording material.

In the image forming apparatus, in general, recording paper (recording material) stacked on a cassette or a feeder is taken out every one sheet by a sheet (paper) feeding member and is fed to an image forming portion. Here, depending on various circumstances, such as variation and deterioration of the recording paper and the sheet feeding member, such a phenomenon called "double feed," in which the recording paper is fed in a state in which a plurality of sheets are superposed and concurrently fed, generates exceptionally in some cases.

For example, in a case in which the recording paper is fed in a double feed state to a fixing device of a film heating type, in which a fixing nip is formed by a heating film (endless belt) and a pressing roller, in the neighborhood of an end portion of doubly fed recording paper with respect to a widthwise direction, a gap generates between the film and the pressing roller by a thickness of the superposed recording materials (recording paper). At that portion, heat of the heater is not readily taken by the pressing roller, so that there is a liability that a fixing member or a heating member is locally increased in temperature at a longitudinal end portion thereof.

In Japanese Laid-Open Patent Application No. 2002-296962, a temperature detecting member for detecting a temperature of the fixing member or the heating member is provided in plurality at different positions with respect to a direction perpendicular to a recording paper feeding direction. Then, at least one temperature detecting member detects a detection temperature gradient $\Delta T$ of the fixing member or the heating member in a predetermined time during passing of the recording paper, to the nip, and the detection temperature gradient $\Delta T$ is compared with a reference value, so that double feed of the recording paper is detected. In the case in which the double feed is detected, electrical power supply to the heating member is immediately turned off or decreased in amount. Such a technique has been proposed.

That is, in Japanese Laid-Open Patent Application No. 2002-296962, a constitution in which, irrespective of a detection temperature, the electrical power supply to the heating member is immediately turned off or decreased in amount in response to the detection temperature gradient $\Delta T$ being not less than a reference value (i.e., generation of abrupt temperature rise) is disclosed.

Even when an abrupt temperature rise is detected, however, the temperature of the fixing member or the heating member does not always increase immediately up to a temperature (error temperature) at which there is a liability of generation of breakage or remarkable deterioration of the fixing member or the heating member. Also, in such a case, when a heater is immediately turned off in response to detection of the abrupt temperature rise as in Japanese Laid-Open Patent Application No. 2002-296962, there is a liability that the turning-off of the heater leads to a lowering in temperature at the nip.

Further, in such a state that recording materials are fed one by one without being doubly fed, it is required that temperature rise to the error temperature is suppressed. Compared with the case of the double feed, however, a possibility that the temperature drastically increases up to the error temperature is low. Accordingly, also for the purpose of ensuring a fixing property or productivity, it is required that the temperature at the nip is not excessively lowered.

SUMMARY OF THE INVENTION

The present invention has been accomplished in view of the above-described circumstances. A principal object of the present invention is to provide an image heating apparatus and an image forming apparatus that are capable of suppressing a lowering in temperature at a nip in a range in which a heater or an endless belt does not readily cause overheating while suppressing the overheating.

According to one aspect, the present invention provides an image heating apparatus comprising an endless belt configured to heat a toner image on a recording material while feeding the recording material through a nip, a rotatable member configured to form the nip in cooperation with the endless belt, a heater including a heat generating element configured to generate heat by energization, the heater being configured to heat the endless belt, a detecting portion configured to detect a temperature of the heat generating element configured to heat a region outside a minimum sheet passing region of the endless belt with respect to a longitudinal direction of the endless belt, wherein the minimum sheet passing region is a region of the endless belt in which, with respect to the longitudinal direction, a minimum-size recording material of recording materials to be fed to the nip passes through the region, and a controller configured to control a temperature at which energization to the heater is turned off, depending on a temperature rise rate per unit time of a detection temperature of the detecting portion, wherein, when the temperature rise rate is a first rise rate, the controller turns off the energization to the heater in response to the detection temperature reaching a first temperature, and, when the temperature rise rate is a second rise rate that is less than the first rise rate, the controller turns off the energization to the heater in response to the detection temperature reaching a second temperature that is greater than the first temperature.

According to another aspect, the present invention provides an image forming apparatus comprising an image forming portion configured to form a toner image on a recording material, an endless belt configured to heat the toner image, formed on the recording material by the image forming portion, while feeding the recording material through a nip, a rotatable member configured to form the nip in cooperation with the endless belt, a heater including a heat generating element configured to generate heat by energization, the heater being configured to heat the endless belt, a sensor configured to detect a temperature of the heat generating element configured to heat a region outside a minimum sheet passing region of the endless belt with respect to a longitudinal direction of the endless belt, wherein the minimum sheet passing region is a region of the endless belt in which, with respect to the longitudinal direction, a minimum-size recording material of recording materials to be fed to the nip passes through the region, a double feed detecting portion configured to detect feeding of a plurality of recording materials to the nip, and a controller configured to control a temperature at which energization to the heater is turned off, depending on a detection result of the double feed detecting portion, wherein, when the feeding of the plurality of recording materials to the nip is detected by the double feed detecting portion, the controller turns off the energization to the heater in response to the detection temperature of the sensor reaching a first temperature, and, when the feeding of the plurality of recording materials to the nip is not detected by the double feed detecting portion, the controller turns off the energization to the heater in response to the detection temperature reaching a second temperature that is greater than the first temperature.

According to still another aspect, the present invention provides an image heating apparatus comprising an endless belt configured to heat a toner image on a recording material while feeding the recording material through a nip, a rotatable member configured to form the nip in cooperation with the endless belt, a heater including a heat generating element configured to generate heat by energization, the heater being configured to heat the endless belt, a detecting portion configured to detect a temperature of the endless belt in a region outside a minimum sheet passing region of the endless belt with respect to a longitudinal direction of the endless belt, wherein the minimum sheet passing region is a region of the endless belt in which with respect to the longitudinal direction, a minimum-size recording material of recording materials to be fed to the nip passes through the region, and a controller configured to control a temperature at which energization to the heater is turned off, depending on a temperature rise rate per unit time of a detection temperature of the detecting portion, wherein, when the temperature rise rate is a first rise rate, the controller turns off the energization to the heater in response to the detection temperature reaching a first temperature, and, when the temperature rise rate is a second rise rate that is less than the first rise rate, the controller turns off the energization to the heater in response to the detection temperature reaching a second temperature that is greater than the first temperature.

Further features of the present invention will become apparent from the following description of exemplary embodiments with reference to the attached drawings.

Figure 4:
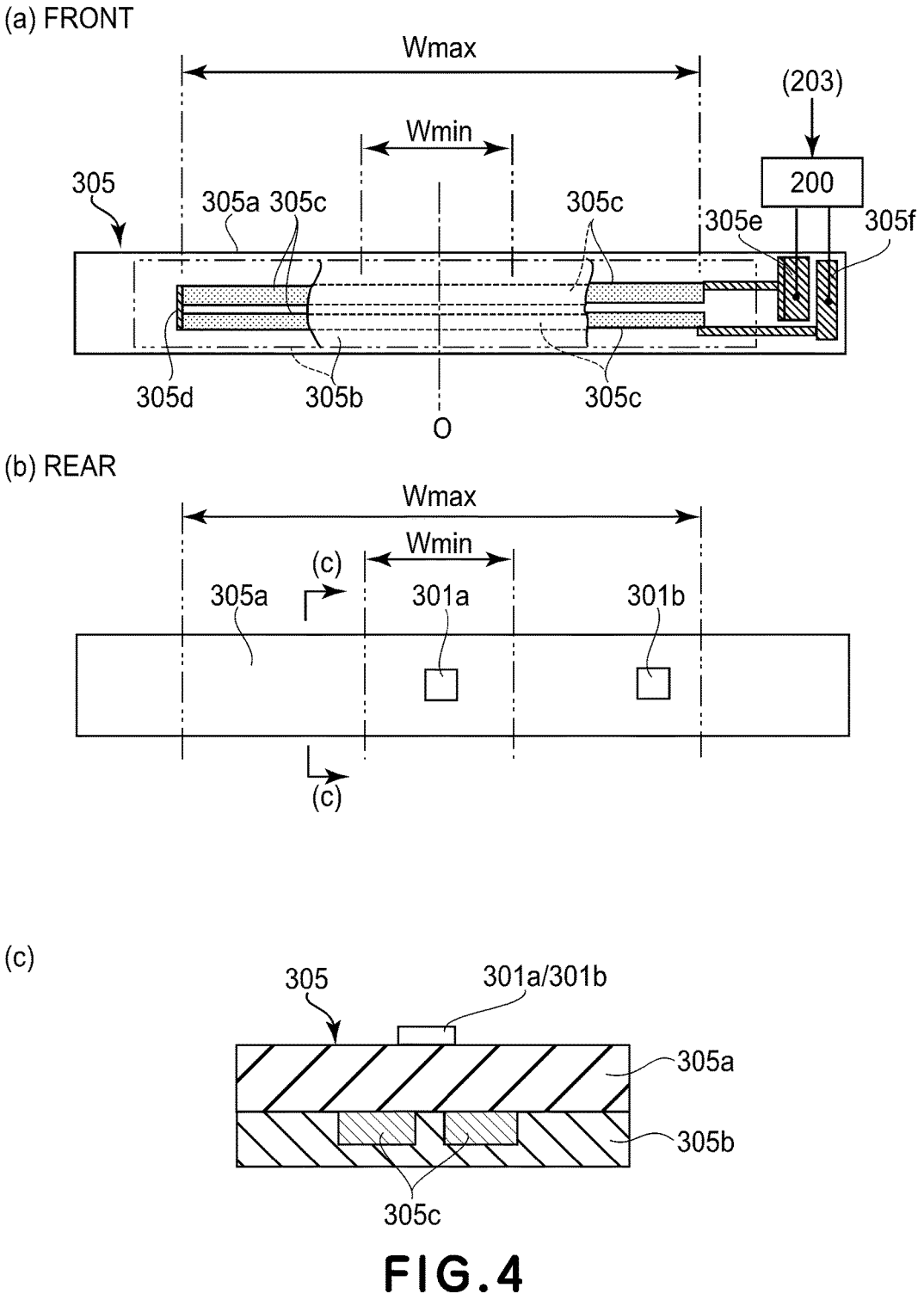

Part (a) of FIG. 4 is a schematic view of a front surface of a heater, the view being partly cut away, part (b) of FIG. 4 is a schematic view of a back surface of the heater, the view being partly cut away, and part (c) of FIG. 4 is a schematic enlarged cross-sectional view of the heater.

Figure 5:
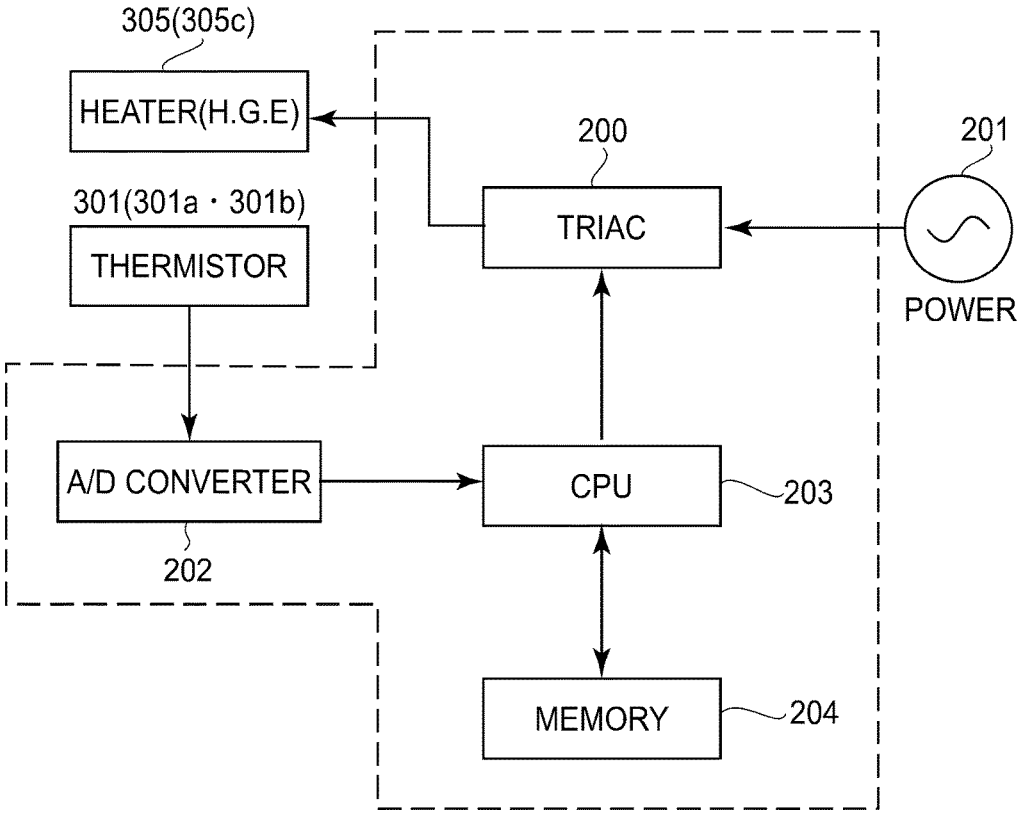

FIG. 5 is a schematic block diagram showing an electrical power supply path from a commercial power source to a heater.

Figure 6:
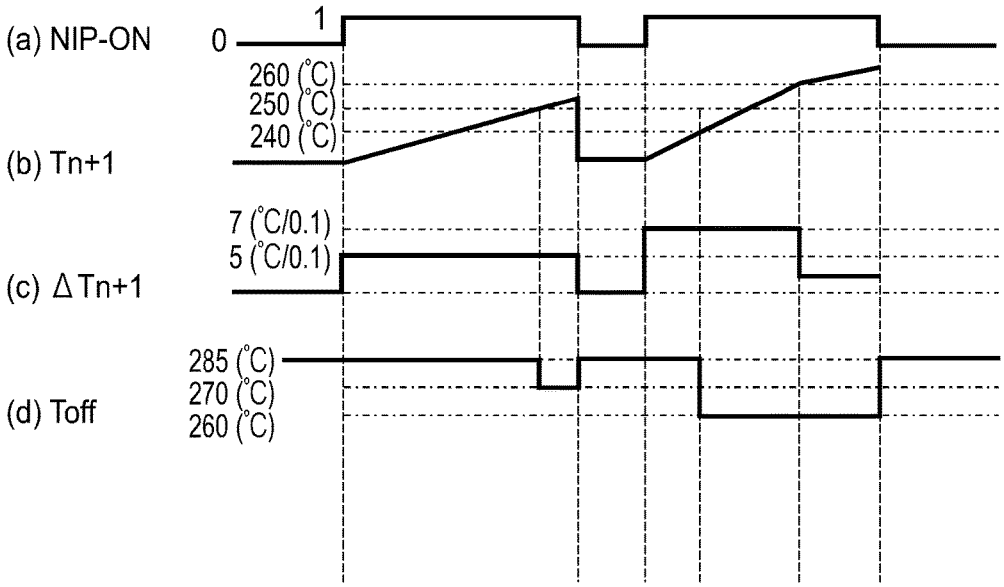

FIG. 6 is a timing chart of the control in Embodiment 1.

Figure 7:
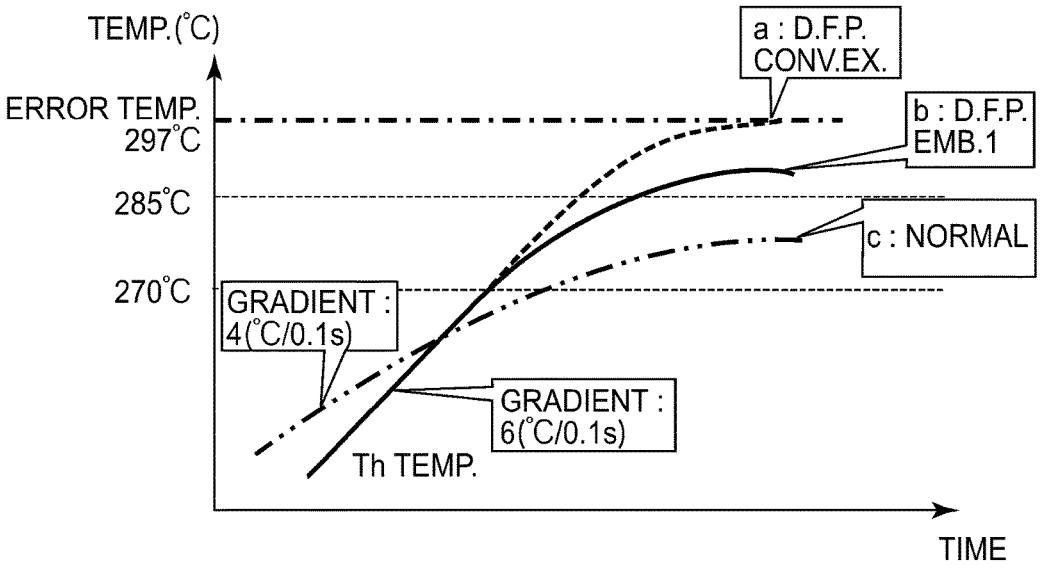

FIG. 7 is a graph showing an effect in Embodiment 1.

Figure 8:
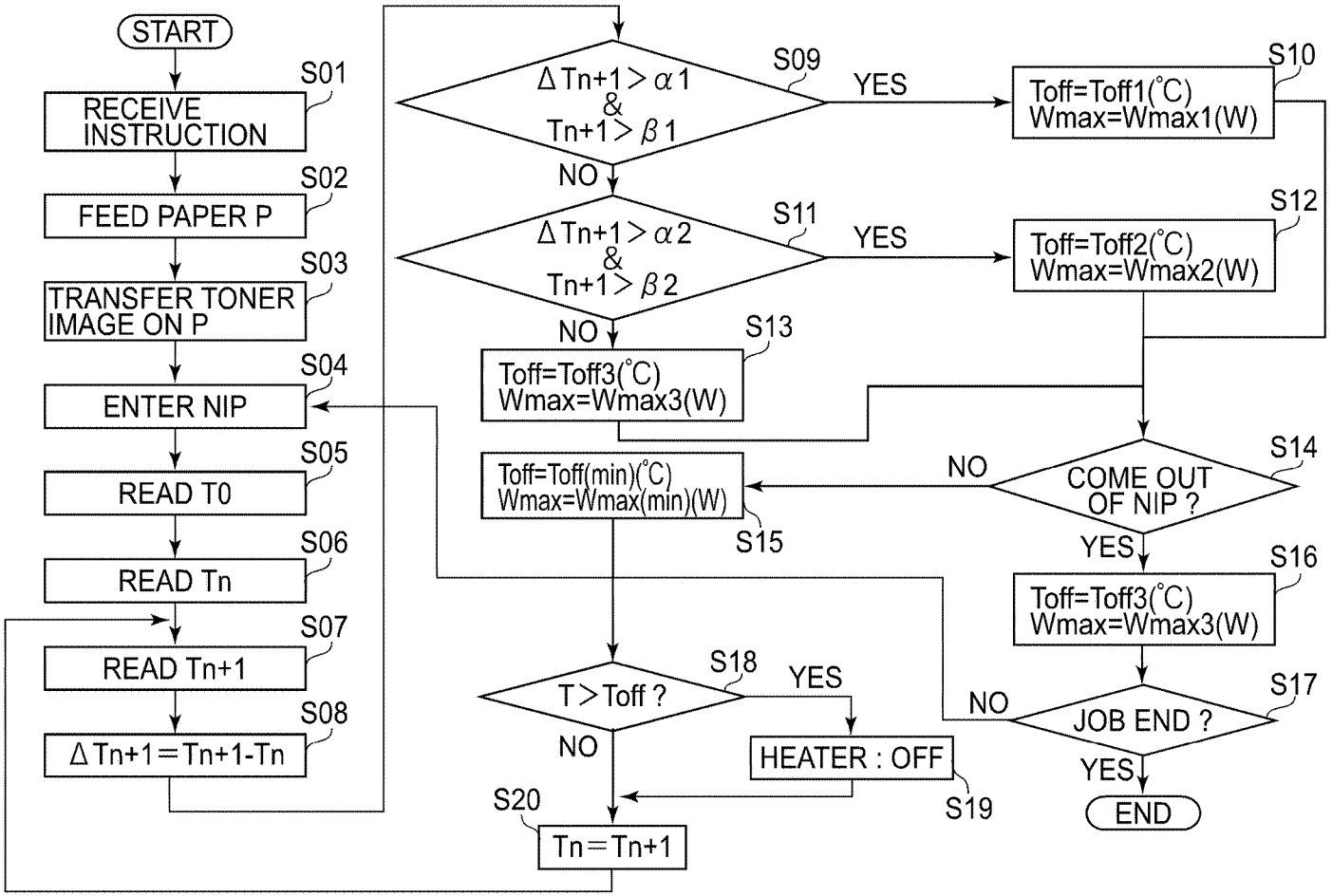

FIG. 8 is a flowchart of control in Embodiment 2.

Figure 9:
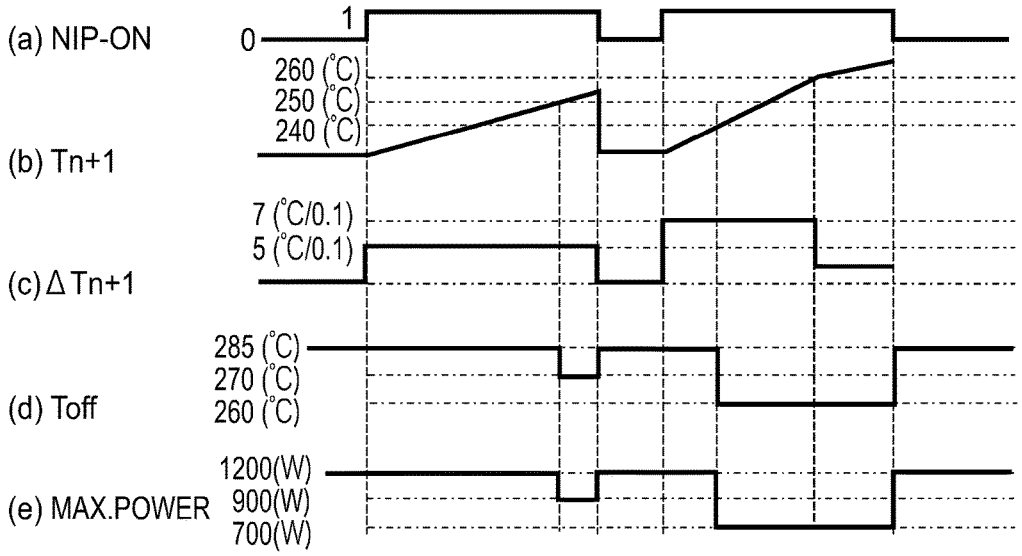

FIG. 9 is a timing chart of the control in Embodiment 2.

Figure 10:
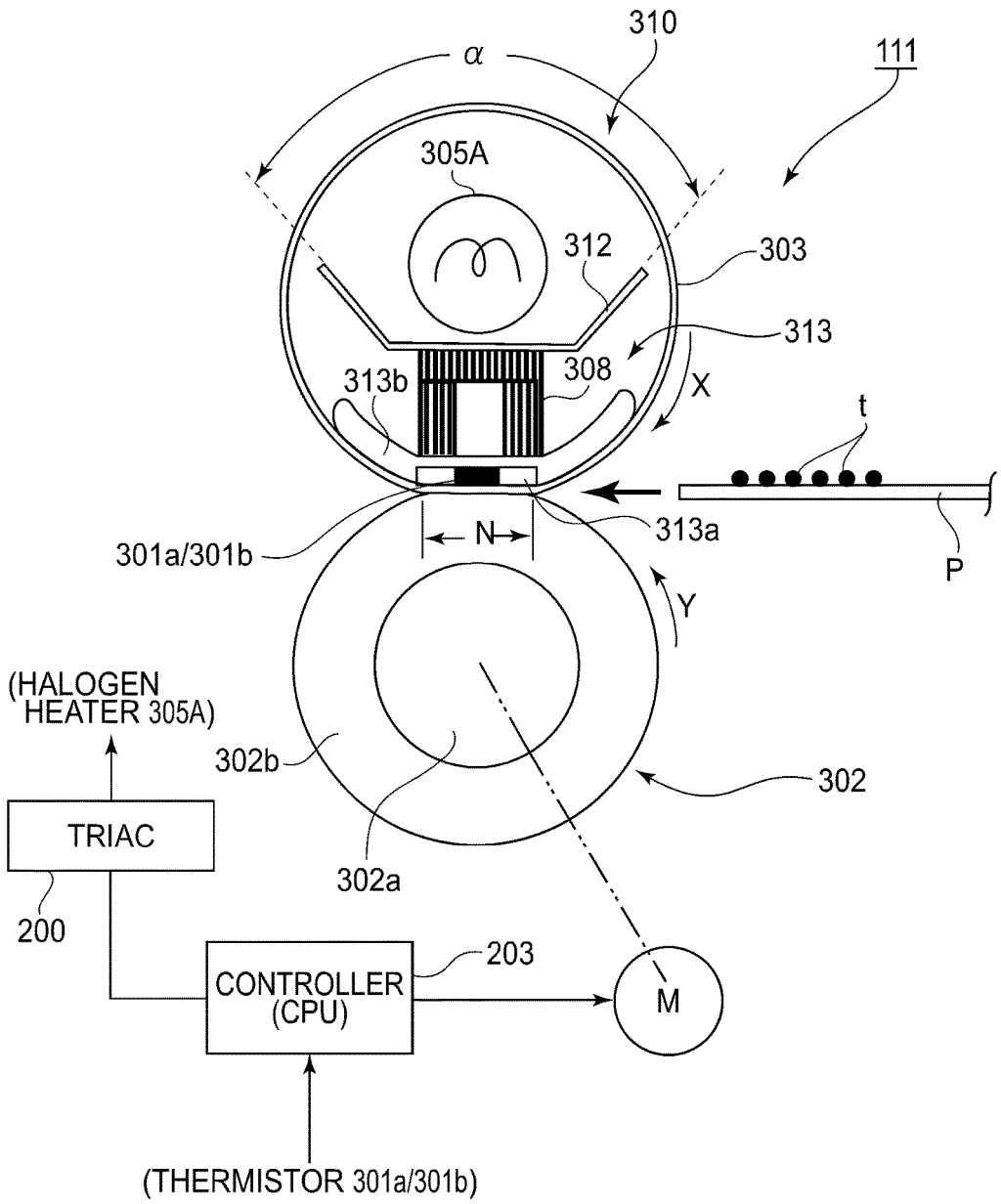

FIG. 10 is a schematic sectional view showing a structure of a principal part of a fixing device according to a reference embodiment.

Figure 11:
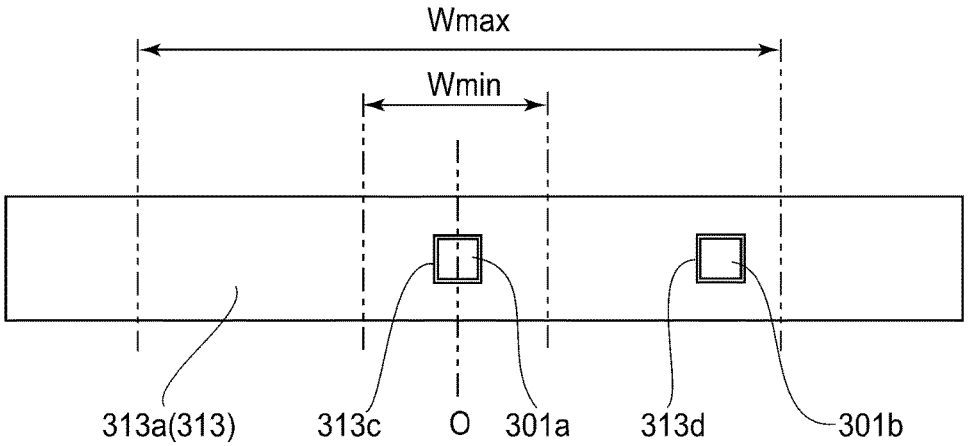

FIG. 11 is a schematic sectional view showing a position of a temperature detecting element in the reference embodiment.

Figure 12:
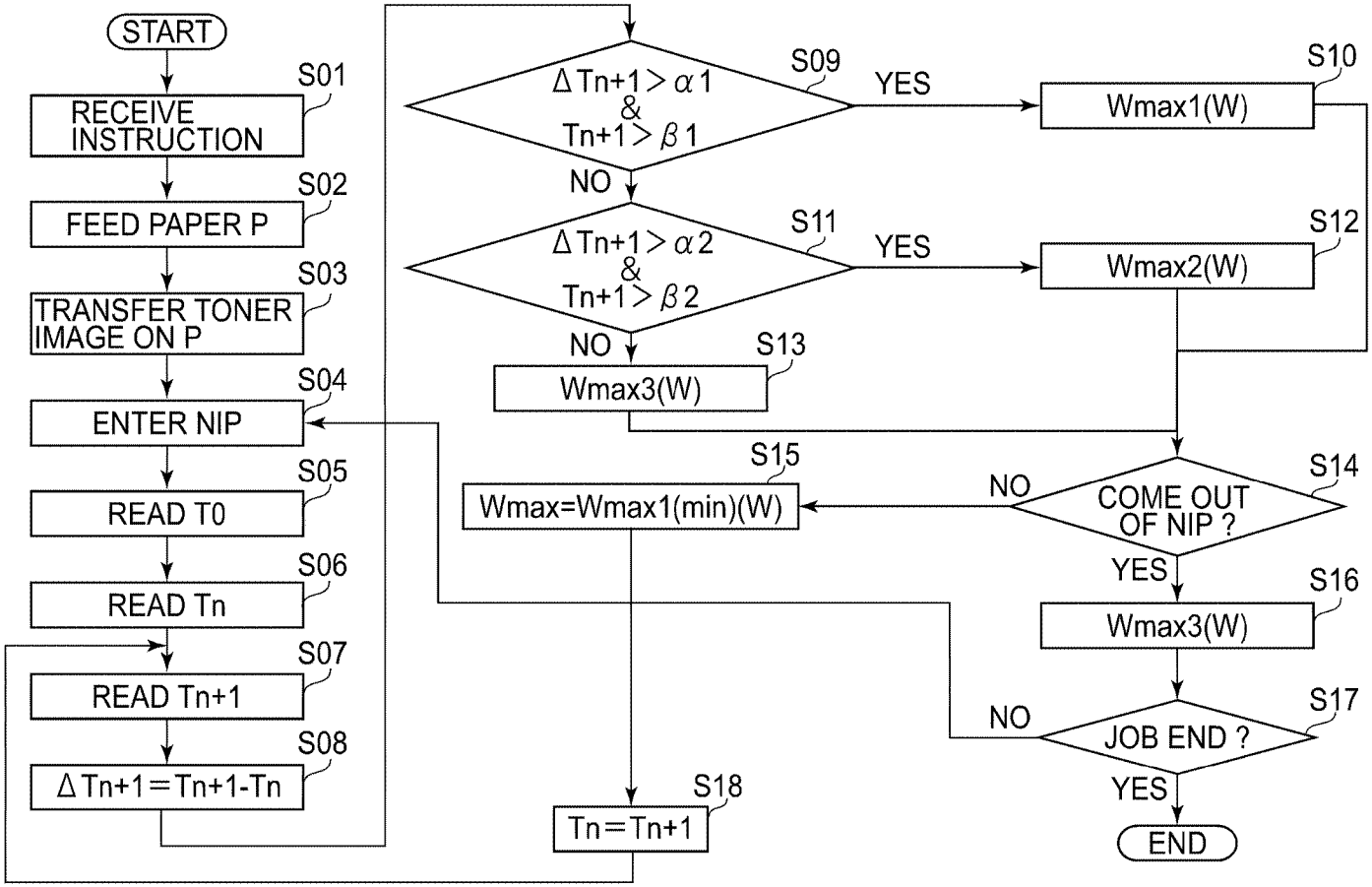

FIG. 12 is a flowchart of control in the reference embodiment.

Figure 13:
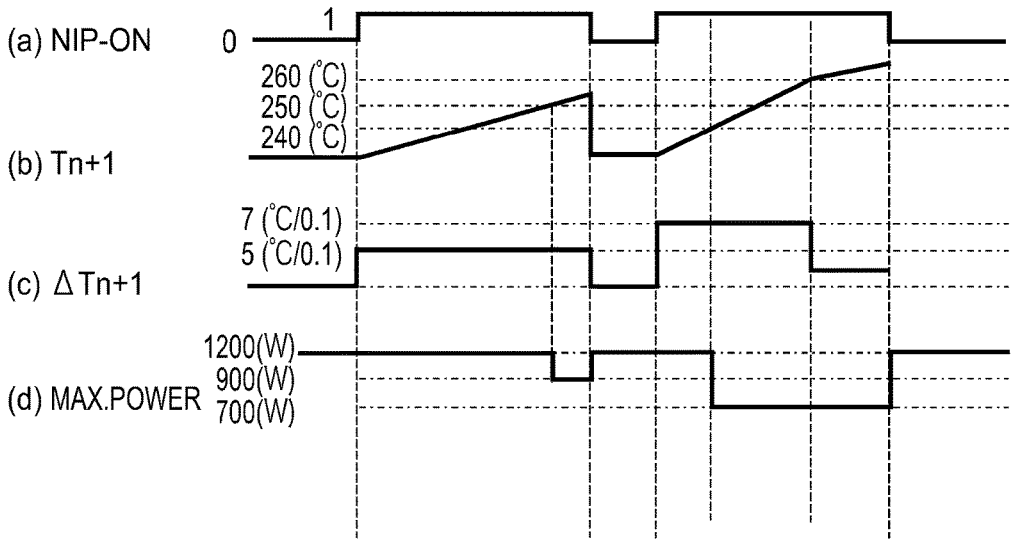

FIG. 13 is a timing chart of the control in the reference embodiment.

Figure 14:
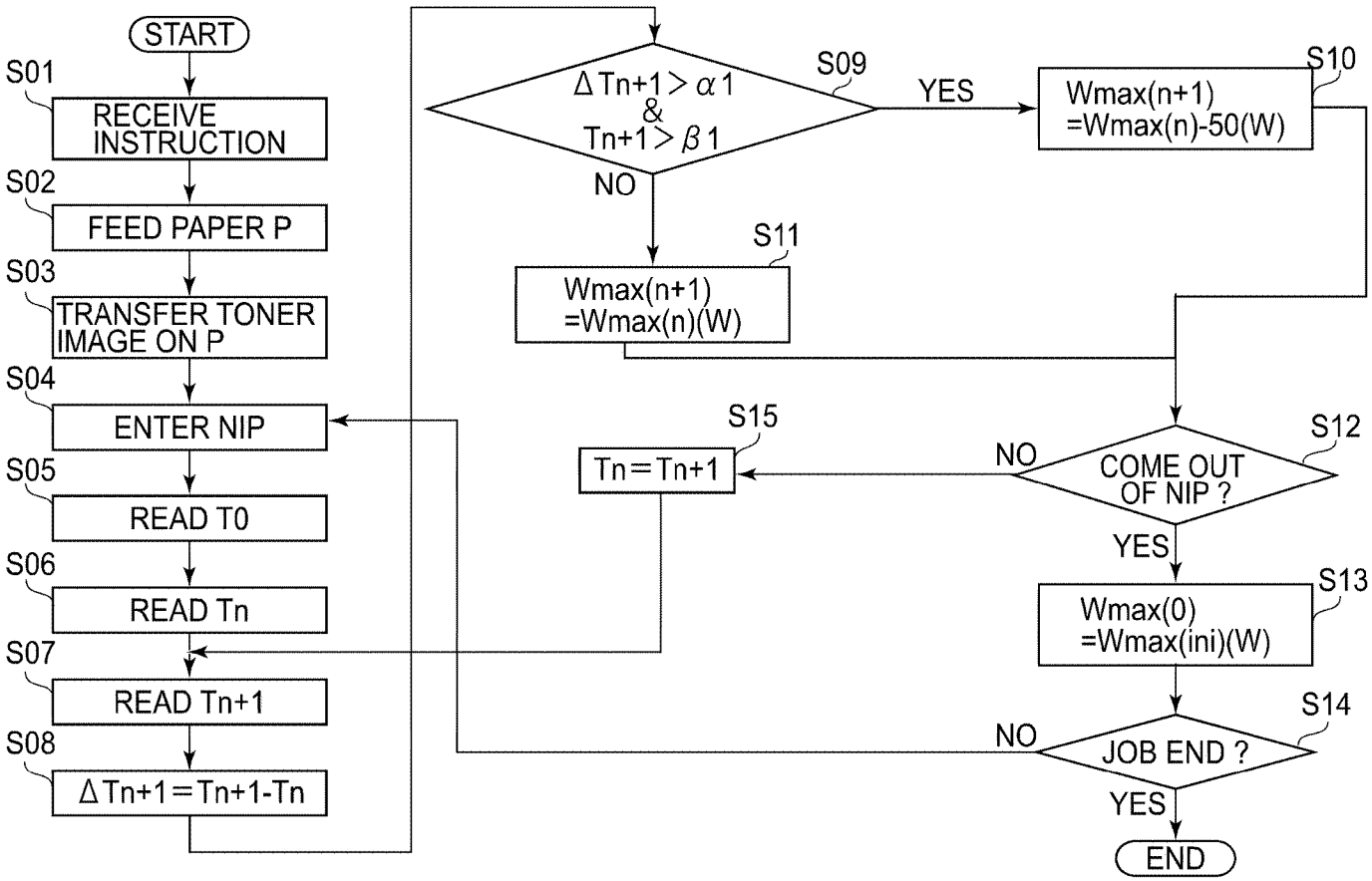

FIG. 14 is a flowchart of control in Embodiment 3.

Figure 15:
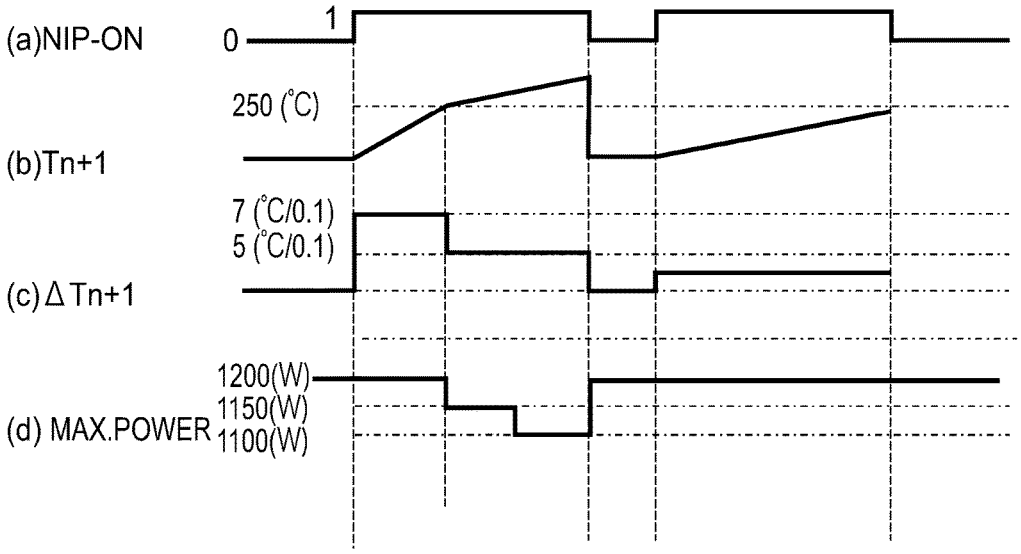

FIG. 15 is a timing chart of the control in Embodiment 3.

DESCRIPTION OF EMBODIMENTS

Embodiment 1

Image Forming Apparatus

Figure 2:
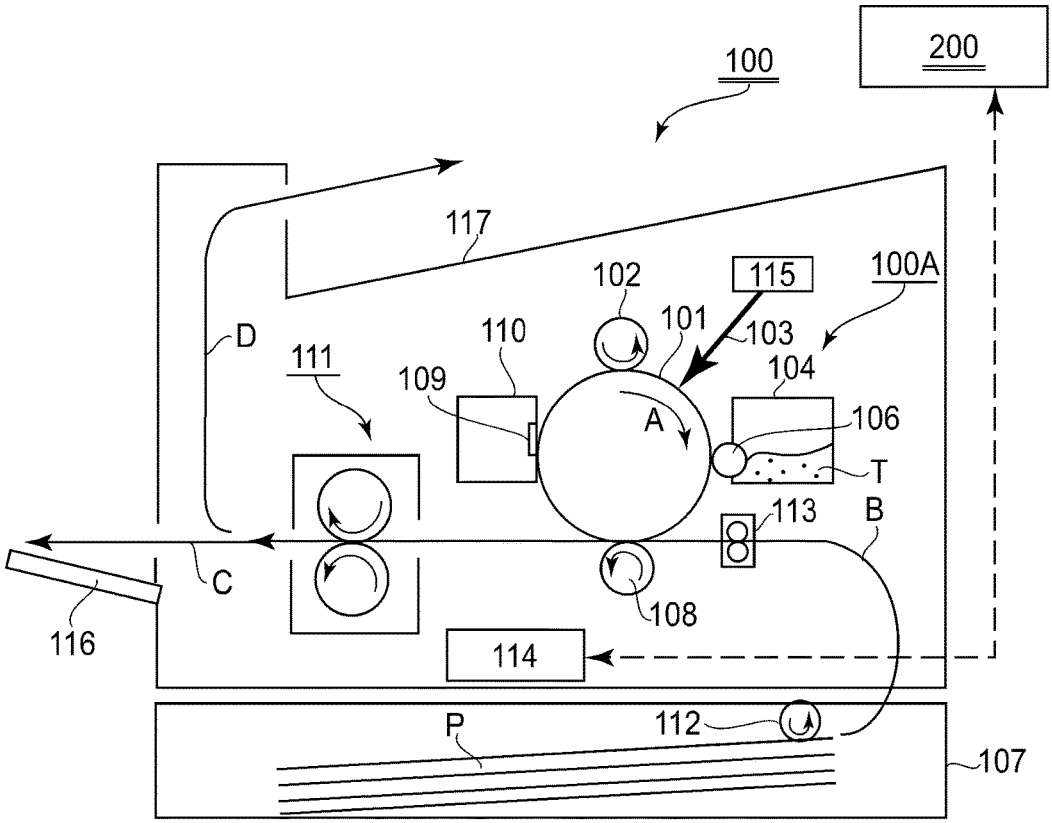
FIG. 2 is a schematic sectional view of an image forming apparatus according to Embodiment 1.

FIG. 2 is a schematic sectional view showing a structure of an image forming apparatus 100 in this embodiment. This image forming apparatus 100 is a laser beam printer using an electrophotographic process. The printer 100 outputs an image-formed product, in which a toner image is formed on a recording material P, by executing a printing operation (image forming operation) corresponding to a print job (provided information) input from a data outputting device 200, such as a host computer, to an engine controller 114.

The print job refers to a print instruction including image data, information on a kind, or the like, of a recording material to be used, and a print condition, such as a layout, the number of sheets, the number of copies, or post-processing. The recording material P refers to a sheet-shaped recording medium on which a toner image (developer member) is to be formed by the image forming apparatus 100. For example, the recording material P includes plain paper, a resin sheet, glossy paper, a postcard, an envelope, a label, a transfer(-receiving) sheet, an electrofacsimile sheet, electrostatic recording paper, an overhead projector (OHP) sheet, a print sheet, format paper, and the like. Hereafter, the recording material P is referred to as recording paper or paper. The engine controller 114 executes a printing operation by effecting integrated control of various image forming devices of the printer 100.

In the printer 100, an image forming portion 100A for forming a toner image on the recording paper P includes a drum-shaped electrophotographic photosensitive member (hereafter referred to as a drum) 101 as an image bearing member for forming the toner image. The drum 101 is rotationally driven in the clockwise direction of an arrow A at a predetermined peripheral speed (process speed). Further, the image forming portion 100A includes, as an electrophotographic process assembly acting on the drum 101, a charging roller 102, an exposure device (laser scanner) 115, a developing device 104, a transfer roller 108, and a cleaning device 110.

From the exposure device 115, laser light 103 as exposure light is emitted. In the developing device 104, toner T as a developer is carried on a developing sleeve 106. The cleaning device 110 includes a cleaning blade 109. An operation for forming an image by the image forming portion 100A is well known, and, therefore, will be omitted from this detailed description.

The recording paper P accommodated in a sheet (paper) feeding cassette (recording material accommodating) portion 107 is taken out every (one) sheet by a sheet feeding roller 112 and passes through a path B, and a leading end thereof is received by a registration roller pair 113 by which oblique movement of the recording paper P is rectified. The registration roller pair 113 sends the recording paper P with predetermined control timing toward a transfer nip, which is a contact portion between the drum 101 and the transfer roller 108, so that a leading end portion of the toner image formed on a drum surface and a leading end portion of the recording paper P are synchronized with each other in a predetermined manner. As a result, the toner image is successively transferred at the transfer nip from the drum 101 side onto the recording paper P side by electrical action.

The recording paper P passed through the transfer nip is separated from the drum surface and is guided into a fixing device (image heating apparatus) 111 and is heated and pressed by the fixing device 111, so that an unfixed toner image, formed on the recording paper P, is fixed as a fixed image on the recording paper (recording material) P. The recording paper P coming out of the fixing device 111 passes through a path C when a face-up (FU) discharge mode is selected, and is discharged on a FU tray 116 with a printing surface facing upward. Further, when a face-down (FD) discharge mode is selected, the recording paper P passes through a path D, and is discharged on a FD tray 117 with the printing surface facing downward.

Fixing Device

Figure 3:
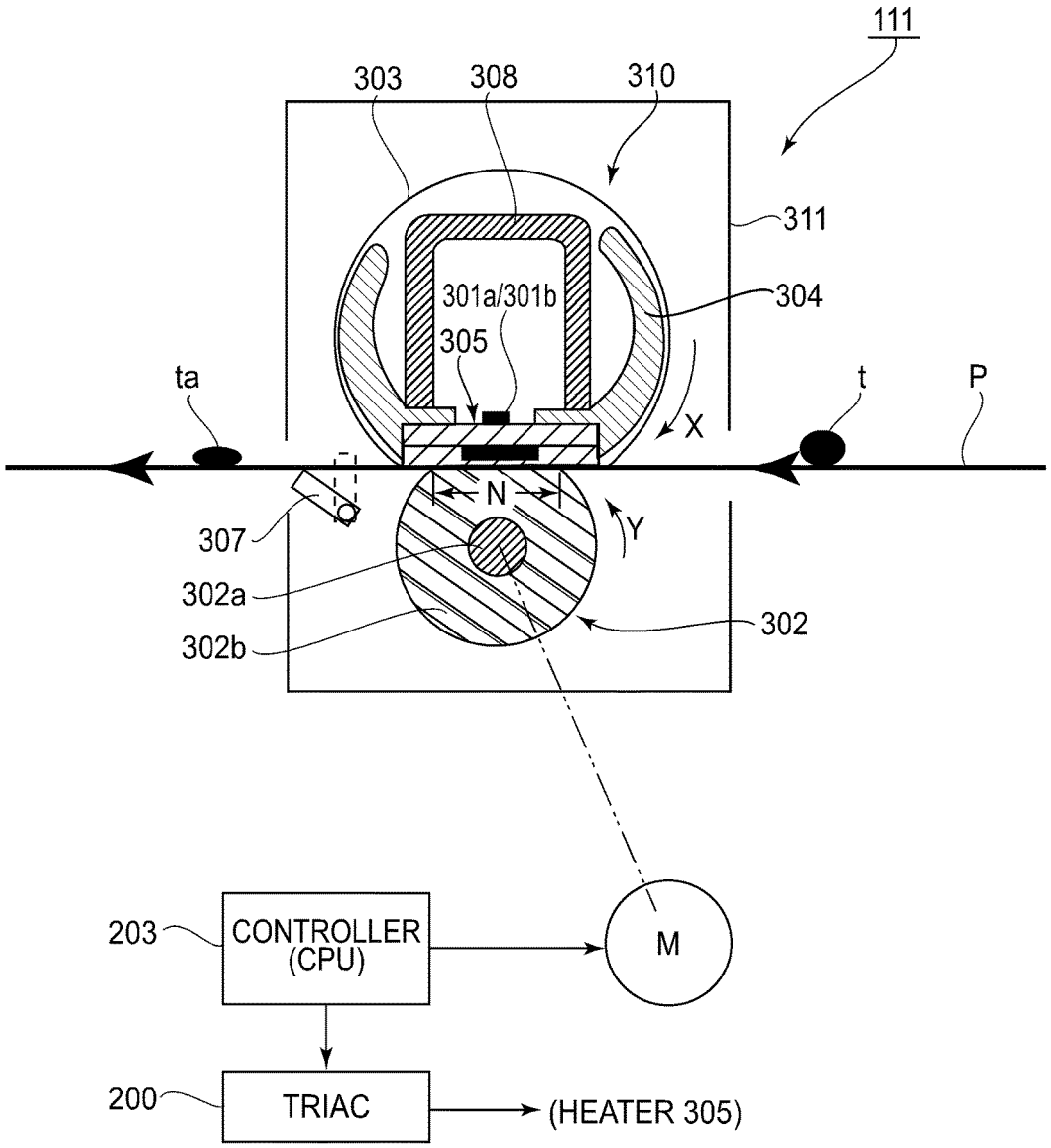
FIG. 3 is a schematic sectional view showing a structure of a principal part of a fixing device according to Embodiment 1.

FIG. 3 is a schematic sectional view showing a structure of a principal part of the fixing device 111. In the following description, with respect to the fixing device 111 and members constituting the fixing device 111, a longitudinal direction is a direction perpendicular to a recording paper feeding direction on a feeding path surface of the recording paper P, and a short-side direction is a direction parallel to the recording paper feeding direction on the feeding path surface of the recording paper P. A width is a dimension with respect to the short-side direction. With respect to the recording paper P, a width is a dimension with respect to the direction perpendicular to the recording paper feeding direction on a surface of the recording paper P. An upstream side and a downstream side are those with respect to the recording paper feeding direction.

The fixing device 111 is of a so-called tension-less type using a film (belt) heating type and a pressing roller drive type in which a pressing roller (pressing member) 302 is rotationally driven and a fixing film (fixing belt, fixing member) 303 is rotated by a feeding force of the pressing roller 302.

The fixing device 111 roughly includes a film unit 310 provided with the pressing roller 302, which is a rotatable driving member, and the fixing film 303, and includes a (fixing) device frame (device casing) 311 including these members. A nip (fixing nip) N is formed by press-contact between the pressing roller 302 and the film 303, which are a pair of rotatable members.

The film 303 is a heat conductive member for heating an unfixed toner image t by conducting heat of the heating member to the toner image t, while being in contact with the toner image t formed on the recording material P. The nip N is a portion in which the recording paper P carrying the toner image t is nipped and fed and thus, the toner image t is fixed as a fixed image on the recording paper P by heat and pressure. A toner image to is the toner image after fixing.

A recording paper sensor (sheet sensor, exit sensor) 307 is provided in the neighborhood of a rise rate exit portion of the nip N on a side downstream of the nip N, and detects arrival of a leading end of the recording paper P coming out of the nip N and also detects passing of a trailing end of the recording paper P. A detection signal thereof is input to a controller (or a central processing unit (CPU)) 203. On the basis of the detection signal, the controller 203 detects that the recording paper P is nip-fed through the nip N and that the recording paper P passed through the nip N.

(1) Pressing Roller

The pressing roller 302 is an elastic roller and is lowered in hardness by providing an elastic layer 302*b* of a silicone rubber, a fluorine-containing rubber, or the like, on a metal core 302*a*. In order to improve a surface property and a parting property with respect to the toner T, on an outer peripheral surface of the elastic layer 302*b*, a fluorine-containing resin layer of polytetrafluoroethylene (PTFE), perfluoroalkoxy alkane (PFA), fluorinated ethylene propylene (FEP), or the like, may also be provided.

The pressing roller 302 is provided so that one end portion and the other end portion of the metal core 302*a* thereof are rotatably supported between side plates (not shown) provided on one end side and the other end side of the fixing frame 311 with respect to the longitudinal direction. The pressing roller 302 is used as a rotatable driving member and is rotationally driven at a predetermined peripheral speed in the counterclockwise direction of an arrow Y by transmission thereto, through a drive transmission mechanism portion (not shown), of a driving force of a motor (driving source) M controlled by the controller 203.

(2) Film Unit

The film unit 310 is an assembly prepared by the film 303, a heater 305 as a heating member, a heater holder 304 as a heating member holding member, a supporting stay 308, flange members (not shown) provided on one end side and the other end, and the like.

The film 303 is used as a heat conductive member, and, in order to realize low thermal capacity and a quick start property, the film 303 is an endless belt member (endless belt) principally formed in a film thickness of 400 μm or less, preferably be about 30 μm to 80 μm, of PTFE, PFA, FEP, or the like, which is a heat-resistant material.

The film 303 can be formed in a single layer structure or a composite layer structure. As the composite layer structure, such a composite layer structure that on an outer peripheral surface of an endless belt member, as a base layer principally formed of a resin material, such as polyimide, polyamideimide, polyether ether ketone (PEEK), polyether sulfone (PES), or polyphenylene sulfide (PPS), or a metal material, such as stainless steel (SUS) or nickel, a 300 μm-thick silicone rubber layer is formed as an elastic layer, and thereon, an approximately 20 μm-thick endless belt member, as a parting layer principally formed of PTFE, PFA or FEP is coated, can be used.

In this embodiment, as the base layer, an approximately 30 μm-thick cylindrical member formed of a nickel alloy is used. On the base layer, as the elastic layer, an approximately 300 μm-thick silicone rubber layer is formed as the elastic layer. On the elastic layer, an approximately 20 μm-thick fluorine-containing resin tube is coated as the parting layer. The thus-prepared endless belt-shaped film of 25 mm in diameter and 350 μm in total thickness was used.

As the heater 305, a ceramic heater is used. As regards this heater 305, detailed description will be made in section (4), appearing hereafter. As the holder 304, a heat-resistant resin material is used. The holder 304 is provided with a groove along a longitudinal direction of an outer surface thereof at a widthwise central portion, and, in this groove, the heater 305 is engaged and fixedly supported.

A stay 308 is a reinforcing member for backing up the holder 304 by being provided inside the holder 304. That is, the stay 308 is a member for supporting the heater 305 through the holder 304. The stay 308 may desirably be formed of a material that is not readily flexed even when a large load is exerted thereon, and, in this embodiment, as the material, SUS304 (stainless steel) mold material, formed in a U-shape in cross section, is used.

Each of the heater 305, the holder 304, and the stay 308 is an elongated member in a widthwise (lengthwise) direction of the film 303, and the film 303 is loosely, i.e., under no tension, fitted externally around an assembly of the heater 305, the holder 304, and the stay 308. That is, the film 303 encompasses the heater 305.

End portions of the stay 308 inside the film 303 project toward outsides of the film 303 from one end portion and the other end portion of the film 303. With the outwardly projecting portions of the stay 308 on one end side and the other end side, flange members provided as terminal members of the film unit 310 on one end side and the other end side, respectively, are engaged. These flange members regulate (prevent) longitudinal movement (thrust movement) and a circumferential shape of the film 303 in the film unit 310. As the flange members, a heat-resistant resin material is used, and, in this embodiment, PPS (polyphenylene sulfide) is used.

The film unit 310 is disposed opposed to the pressing roller 302 on the heater 305 side substantially in parallel to the pressing roller 302, so that the flange members on one end side and the other end side are engaged with slide slit portions provided on the side plates of the fixing frame 311 on one end side and the other end side, respectively. Further, the flange members on one end side and the other end side are urged (pressed) toward an axial direction of the pressing roller 302 by an urging force of pressing springs of pressing mechanisms (not shown). As a result, the film 303 is press-contacted to the pressing roller 302 against elasticity of the elastic layer 302*b* by the stay 308, the holder 304, and the heater 305.

In this embodiment, a pressing force (pressure) exerted on the film unit 310 is about 156.8 N (16 kgf) on each of one end side and the other end side, and a total pressing force is about 313.3 N (32 kgf). By the pressing force, between the film 303 and the pressing roller 302, the nip N with a predetermined width with respect to a recording paper feeding direction is formed. During a stand-by state of the printer 100, the pressing force of the pressing mechanism is released (eliminated) by a pressure-releasing mechanism (not shown), so that the press-contact between the film 303 and the pressing roller 302 is released (or reduced in press-contact force). That is, the film unit 310 is held in a state in which formation of the nip N is substantially eliminated.

(3) Fixing Operation

The controller 203 causes, at predetermined control timing in an execution sequence of a print job, the pressing mechanism in a pressure-released state to perform a pressing operation, so that the nip N is formed between the film 303 and the pressing roller 302. Then, the controller 203 actuates the motor M, so that the pressing roller 302 is rotationally driven at a predetermined peripheral speed in the counter-clockwise direction of an arrow Y.

The pressing roller 302 is rotationally driven, whereby a rotational force acts on the film 303 by a frictional force between the surface of the pressing roller 302 and the surface of the film 303 in the nip N. For that reason, the film 303 is rotated by the rotational drive of the pressing roller 302 at a peripheral speed substantially equal to the peripheral speed of the pressing roller 302 in the clockwise direction of an arrow X along an outer peripheral surface of the holder 304 while sliding with the holder 304 in intimate contact with the heater 305 at an inner peripheral surface thereof. The holder 304 has a semicircular shape in cross section and has a function of regulating a rotational orbit (locus) of the film 303.

Together with the rotational drive of the pressing roller 302, electrical power is supplied through an energization path (not shown) to the heater 305 from a triac (energizing portion) 200 controlled by the controller 203. As a result, the heater 305 abruptly increases in temperature. A temperature of the heater 305 is increased up to a predetermined target temperature (fixing temperature) and is controlled, as described later.

Then, in a state in which the pressing roller 302 is rotationally driven and the heater 305 is increased in temperature up to the predetermined target temperature and is temperature-controlled at the predetermined target temperature, the recording paper P, on which the unfixed toner image t is formed, is sent from the image forming portion 100A side to the fixing device 111, and is then guided into the nip N. In a process in which the recording paper P is nipped and fed through the nip N, heat of the heater 305 is imparted to the recording paper P through the film 303. The unfixed toner image t is melted by the heat of the heater 305 and is fixed as a fixed image to on the recording paper P by pressure exerted on the nip N.

(4) Structure of Heater and Electrical Power Supply Control

Parts (a) to (c) of FIG. 4 are schematic views for illustrating a structure of the heater 305 in this embodiment. In FIG. 14, part (a) is a schematic view of a front surface of the heater, the view being partly cut away, part (b) is a schematic view of a back surface of the heater 305, and part (c) is an enlarged view of the heater 305 in cross section taken along (c)-(c) line in part (b). The heater 305 is a so-called ceramic heater and is a laterally elongated planar heating element (member) showing an abrupt temperature rising characteristic by energization and having low thermal capacity. The heater 305 includes a thin and long heater substrate 305*a* and heat generating elements 305*c* formed along a longitudinal direction on one surface side (front surface side, a sliding surface side of the heater 305 with the film 303).

The heater substrate 305*a* principally comprises high-heat-conductive ceramics, such as alumina ($Al_2O_3$) or aluminum nitride (AlN). In this embodiment, as the heater substrate (ceramic substrate) 305*a*, a thin and long plate member formed of aluminum nitride (thermal conductivity: 100 W/(m·K) in a length of 350 mm, a width of 9 mm, and a thickness of 1 mm is used.

The heat generating elements 305*c* are heat generating resistors (energization heat generating layers) prepared by coating an electrical resistance material, such as tantalum silicate ($TaSiO_2$), silver palladium AgPd), tantalum nitride ($Ta_2N$), ruthenium oxude ($RuO_2$), or nichrome, on the substrate 305*a* by screen printing and by then sintering the electrical resistance material. In this embodiment, two parallel heat generating elements 305*c*, each of 300 mm in length, 2 mm in width, and 20 μm in thickness, are formed with an interval therebetween of 0.5 mm. End portions of the two parallel heat generating elements 305*c* on one end side are electrically connected with each other in series by an electroconductive material 305*d* printed on the heater substrate surface. End portions of the two parallel heat generating elements 305*c* on the other end side are electrically connected (conducted) to electrodes 305*e* and 305*f*, respectively, formed of an electroconductive material printed on the heater substrate surface.

The front surface of the heater substrate 305*a* is coated with a protective layer 305*b*, except for portions of the electrodes 305*e* and 305*f*, principally formed of glass or a fluorine-containing resin material, or the like, so as to cover the heat generating elements 305*c* and the electroconductive material 305*d* in order to protect these portions from sliding, or the like, with the film 303.

On the back surface side (non-sliding surface side of the heater 305 with the film 303) of the heater substrate 305*a*, temperature sensors (temperature detecting elements, hereafter referred to as thermistors) 301 for detecting a temperature of the heater 305 are provided. In this embodiment, two (first and second) thermistors 301 and 302*b* are formed. The first thermistor 301*a* is disposed, as a temperature detecting element for controlling the temperature of the heater 305, at a position corresponding to a longitudinal central portion of the heat generating elements 305*c*. The second thermistor 301*b* is disposed, as a temperature detecting element for detecting double feed of the recording paper, at a position of 115 mm apart from the first thermistor 301*a* toward the other end side of the heater substrate 305*a*.

The heater 305 is fixedly supported by being engaged in a groove provided along the longitudinal direction at a widthwise central portion of an outer surface of the holder 304 with the heater front surface side (one surface side where the heat generating elements 305*c* are formed on the heater substrate 305) outward. The heat generating elements 305*c* generate heat in a full-length region by being supplied with electrical power from the triac 200 via the electrodes 305*e* and 305*f*. By this heat generation of the heat generating elements 305*c*, a heater portion corresponding to the full-length region of the heat generating elements 305*c* is heated.

In the printer 100 of this embodiment, feeding of the recording paper P is carried out on a so-called center line basis. That is, recording paper sheets that are usable in the printer and that have any width (large and small widths) are fed so that a widthwise centers thereof pass through a reference center feeding line (recording material feeding center line). In part (a) of FIG. 4, the reference center feeding line is indicated as a phantom line O.

Wmax represents a passing region width of a maximum-width-size recording paper usable in the device. In this embodiment, Wmax is a passing region width of A3-size sheet (short side (297 mm) feeding), and the length (300 mm) of the heat generating elements 305*c* is set correspondingly to Wmax. Wmin represents a passing region width of a minimum-width-size recording paper usable in the device. The first thermistor 301*a* is disposed substantially correspondingly to the reference center feeding line O.

Electrical power supply to the heater 305 will be described with reference to FIG. 5. FIG. 5 is a schematic block diagram showing an electrical power supplying path from a commercial power source 201 to the heat generating elements 305*c* of the heater 305. The heat generating elements 305*c* are supplied with electrical power from the commercial power source 201 via the triac 200, and the electrical power supply from the commercial power source 201 to the heat generating elements 305*c* is controlled by the central processing unit (CPU) 203, which is the controller (also referred to as an electrical power supplying means controller).

Temperature information of the heater 305 with heat generation of the heat generating elements 305*c* is converted from analog information of the first thermistor 301*a*, disposed within a range of the passing region width Wmin of the minimum-width-size recording paper on the heater 305, into digital information by an analog/digital (A/D) converting circuit 202. The digital information is input to the CPU 203. The CPU 203 compares the input temperature information with a predetermined target temperature (fixing temperature). Then, on the basis of a difference therebetween, the CPU 203 subjects the electrical power, supplied from the commercial power source 201 to the heat generating elements 305*c*, to proportional integral derivative (PID) control via the triac 200, and controls the temperature of the heater 305 so that the temperature of the heater 305 in the sheet (paper) passing region becomes a predetermined target temperature.

The CPU 203 monitors the temperature information of the heater 305 every predetermined cyclic period and corrects the electrical power supplied to the heater 305 every predetermined cyclic period. In this embodiment, wave-number control, in which in the predetermined cyclic period, whether or not a wave-number range is subjected to electrical power supply from the commercial power source 201 to the heat generating elements 305*c* is selected every half-wave of an alternating current (AC) power source (voltage) output from the commercial power source 201, is employed. Adjustment of an amount of the electrical power supply from the commercial power source 201 to the heat generating elements 305*c* over the predetermined cyclic period is also carried out by phase control, other than the wave-number control, in which a phase range is deteriorated every half-wave of the AC power source (voltage) output from the commercial power source 201.

The first thermistor 301*a* is a temperature detecting element for heater temperature control in order to maintain the target temperature of the heater 305 from a start (rising) of a heating process of the fixing device 111 in an image fixing step in which the image is fixed on the recording paper in a print job. For that reason, the first thermistor 301*a* is disposed within a range of the passing region width Wmin of the minimum-width-size recording paper on the heater 305 and substantially corresponds to the position of the reference center feeding line O in this embodiment.

That is, the first thermistor 301*a* detects a temperature corresponding to a sheet passing portion (recording paper passing portion feeding) in the nip N when the recording material is guided to the fixing device 111. On the basis of a temperature detected by the first thermistor 301*a*, the controller 203 controls the electrical power supply from the triac 200 to the heater 305 so that a temperature of the sheet passing portion in the nip N is maintained at the recording paper target temperature.

(5) Double Feed Detection of Recording Paper and Device Control

The second thermistor 301*b* is a temperature detecting element for detecting double feed of the recording paper, and analog information of the second thermistor 301*b* is converted into digital information by the A/D conversion circuit 202. The CPU 203 carries out double feed detection on the basis of input temperature information of the heater 305.

The second thermistor 301*b* is the temperature detecting element for detecting a detection temperature gradient ΔT (slope (gradient) of a change in temperature with time) of the heater 305 in a predetermined time device passing of the recording paper P through the nip N. For that reason, the second thermistor 301*b* is disposed out of the passing region width Wmin of the minimum-width-size recording paper.

That is, the second thermistor 301*b* detects a temperature corresponding to a non-sheet passing portion (recording non-paper passing portion feeding) in the nip N when the recording paper P is guided to the fixing device 111. On the basis of the temperature detected by the second thermistor 301*b* and the slope (gradient) of the change in detection temperature with time, in this embodiment, the controller 203 effects control so as to stop electrical power supply from the triac 200 to the heater 305. Specifically, as shown in a flowchart described later, on the basis of the detection temperature detected by the second thermistor 301*b* and the slope (gradient) of the change in detection temperature with time, the CPU 203 changes (controls) setting of a temperature at which energization to the heater 305 is forcedly turned off. The slope (gradient) of the change in detection temperature with time specifically refers to a temperature rise rate per unit time of the detection temperature. In a period until the detection temperature of the second thermistor 301*b* becomes a set temperature (forced OFF temperature), the CPU 203 permits the energization to the heater 305 and controls the temperature of the heater 305 so as to become a target temperature of the heater 305. Then, the CPU 203 turns off the energization to the heater 305 in response to the detection temperature of the second thermistor 301*b* becoming the set temperature (forced OFF temperature).

As described above, the analog information of the second thermistor 301*b* is converted into the digital information by the A/D conversion circuit 202 and is input to the CPU 203. Here, when a constitution in which the digital information is converted into the analog information and the detection temperature gradient ΔT is calculated on the basis of the analog information is employed, an error is less than that in a constitution in which the detection temperature gradient ΔT is calculated on the basis of the digital information. This is because the analog information and the digital information are not in a proportional relationship.

From the detection temperature gradient ΔT and the detection temperature, which were detected by the second thermistor 301*b*, the CPU 203 discriminates that the recording paper is double fed paper and changes the control. That is, the CPU 203 functions as a double feed detecting portion. An example of a specific detecting method is shown in the flowchart described later. The CPU 203 changes the control on the basis of information stored in a memory 204.

Figure 1:
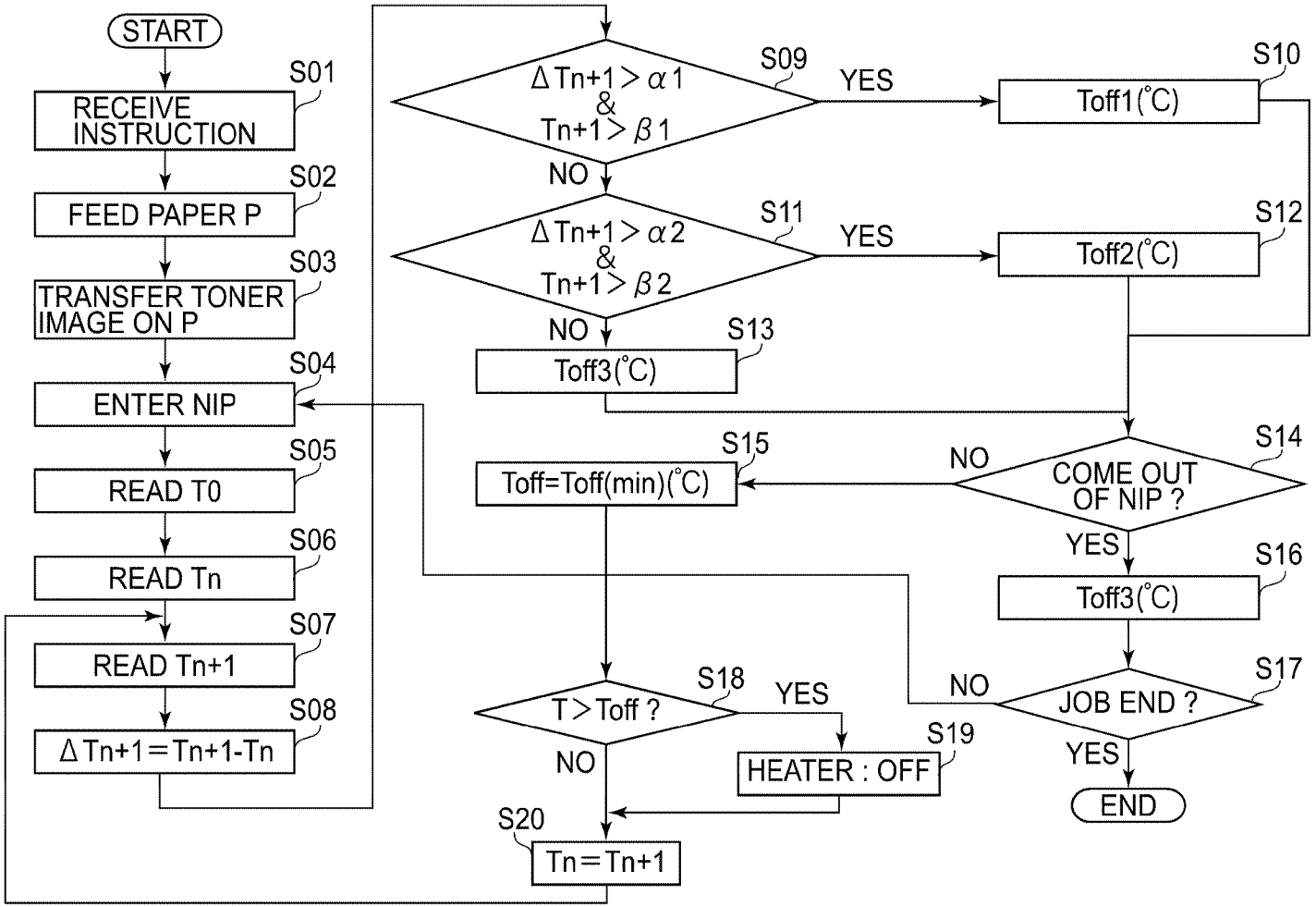
FIG. 1 is a flowchart of control in Embodiment 1.

This control will be described using a flowchart of FIG. 1. First, the CPU 203 provides a print instruction (step S01). The image forming apparatus received the print instruction supplies the recording paper P (step S02). Then, the respective portions of a main assembly of the image forming apparatus operate as described above, so that the toner image is transferred at the transfer nip onto the recording paper P fed from the registration roller pair 113 (step S03).

The recording paper P, on which the transferred image is formed, enters the fixing nip N of the fixing device 111 (step S04). In order to ensure that the CPU 203 discriminates entrance of the recording paper P into the fixing nip N, when the fixing device 111 is provided with an entrance sensor, a signal of the entrance sensor may only be required to be used. When the fixing device 111 is not provided with the entrance sensor, it is possible to discriminate that the recording paper P entered the fixing nip N by dividing a feeding distance by a feeding speed.

In this embodiment, the CPU 203 reads the temperature of the second thermistor 301*b* for every period of a lapse of 0.1 second from a time when the recording paper P enters the fixing nip N. The CPU 203 reads a temperature T0 of the second thermistor 301*b* when the recording paper P enters the fixing nip N (step S05). Then, after a lapse of n seconds (i.e., after a lapse of 0.1 second from step S05), the CPU 203 reads a temperature Tn of the second thermistor 301*b* (step S06). Then, after a lapse of n+1 seconds (i.e., after a lapse of 0.1 second from step S06), the CPU 203 reads a temperature Tn+1 of the second thermistor 301*b* (step S07).

Incidentally, n and n+1 are symbols and do not limit a temperature reading interval of the second thermistor 301*b* to 0.1 second.

The detection temperature gradient is detected, and, therefore, the CPU 203 calculates $\Delta Tn+1=Tn+1-Tn$ (step S08). The CPU 203 also calculates an initial temperature gradient $\Delta T1=T1-T0$.

The CPU 203 discriminates whether or not the detection temperature gradient (temperature difference) ΔTn+1 is greater than α1 (first predetermined temperature difference threshold) and is greater than β1 (first predetermined temperature threshold) (step S09).

When a result of the discrimination is correct (YES), the CPU 203 sets a forced-heater-OFF temperature at Toff1 (° C.) (step S10). When the result of the discrimination is not correct (NO), the sequence goes to step S11.

Forced-heater-OFF control refers to control in which, when the second thermistor 301*b* detects the forced-heater-OFF temperature, an amount of electrical power supply to the heater 305 is made zero.

In step S11, the CPU 203 discriminates whether or not the detection temperature gradient (temperature difference) ΔTn+1 is greater than α2 (second predetermined temperature difference threshold: $\alpha2<\alpha1$) and is greater than β2 (second predetermined temperature threshold: $\beta2>\beta1$) (step S11). When a result of the discrimination is correct (YES), the CPU 203 sets the forced-heater-OFF temperature at Toff2 (° C.) (>Toff1 (° C.)) (step S12). When the result of the discrimination is not correct (NO), the CPU 203 sets the forced-heater-OFF temperature at Toff3 (° C.) (>Toff2 (° C.)) (step S13).

Here, the forced-heater-OFF temperature set in either of steps S11 and S12 is stored in a memory incorporated in the CPU 203. Incidentally, the memory may also be a memory other than the memory incorporated in the CPU 203.

Next, the CPU 203 discriminates whether or not a trailing end of the recording paper P passed through the fixing nip N (step S14).

The CPU 203 discriminates whether or not the heater 305 should be forcedly turned off using, as an actual forced-heater-OFF temperature, a lowest temperature of forced-heater-OFF temperatures set during passing of single recording paper P through the fixing nip N.

That is, when the trailing end of the recording paper P does not pass through the fixing nip N, the CPU 203 employs the forced-heater-OFF temperature in the following manner. Of the forced-heater-OFF temperatures (Toff1, Toff2, and Toff3) set from entrance of a leading end of the recording paper P into the fixing nip N until the discrimination of step S14 is made, the lowest temperature (Toff(min)) is employed as the actual forced-heater-OFF temperature (Toff) (step S15).

Incidentally, as shown in steps S05 to S15 and S18 to S20, in a period from when the leading end of the recording paper P reaches the fixing nip N until the trailing end of the recording paper P passes through the fixing nip N, discrimination of the forced-heater-OFF temperature on the basis of the detection temperature gradient is repetitively made. That is, the CPU 203 reads the temperature of the second thermistor 301*b* every 0.1 second, and sets the forced-heater-OFF temperature correspondingly.

For example, in the period when the forced-heater-OFF temperatures set in steps S09 to S13 are Toff1 and Toff2, the following operation is performed. That is, in the period until the recording paper P passes through the fixing nip N, in step S15, the actual forced-heater-OFF temperature is continuously set at Toff1 (set in step S10) (step S15).

Next, the CPU 203 discriminates whether or not the thermistor detection temperature Tn+1 read in the last step S07 exceeds the actual forced-heater-OFF temperature in step S15 (step S18). When the thermistor detection temperature Tn+1 read in the last step S07 exceeds the actual forced-heater-OFF temperature set in step S15, the amount of the electrical power supplied to the heater 305 is made zero (forced-heater-OFF) (step S19), and the sequence goes to step S20.

On the other hand, when the thermistor detection temperature Tn+1 read in the last step S07 does not exceed the actual forced-heater-OFF temperature set in step S15, the CPU 203 continues temperature adjustment while supplying the electrical power to the heater 305, and the sequence goes to step S20.

Then, the thermistor detection temperature Tn+1 read in the last step S07 is set at Tn (step S20). Then, after a lapse of 0.1 second from the reading of the detection temperature of the second thermistor 301*b* in the last step S07, the CPU 203 reads the detection temperature Tn+1 of the second thermistor 301*b* again (step S07). That is, the CPU 203 continuously detects the detection temperature gradient while reading the temperature of the second thermistor 301*b* every 0.1 second.

When the trailing end of the recording paper P passes through the fixing nip N, the CPU 203 sets the forced-heater-OFF temperature at Toff3 (° C.), which is a default (step S16). In step S17, the CPU 203 discriminates whether or not the print job is a print job (JOB) of a plurality of sheets and subsequent recording paper P comes to the fixing nip N. When the subsequent recording paper P comes to the fixing nip N, the sequence returns to step S04. That is, in a case in which the energization to the heater 305 is turned off with the arrival of the thermistor temperature at the forced-heater-OFF temperature, when the job is not ended, the image forming operation is continued.

There is a possibility that first sheets are double fed paper and a subsequent sheet is not the double fed paper, and, therefore, in step S16, the forced-heater-OFF temperature was returned to Toff3 (° C.). In step S17, when the job is ended, the sequence of this control is ended.

Parameters n, $\alpha 1$, $\alpha 2$, $\beta 1$, $\beta 2$, Toff1, Toff2, and Toff3 in this control are summarized in Table 1, appearing hereafter.

In Table 1, n=0.1 (s), $\alpha 1$=7 (° C./0.1 s), $\alpha 2$=5 (° C./0.1 s), ($\beta 1$=240 (° C.), ($\beta 2$=250 (° C.), Toff1=260 (° C.), Toff2=270 (° C.), and Toff3=285 (° C.) were set.

This setting was made since, when a value of the detection temperature gradient $\alpha$ is large, the forced-heater-OFF temperature is required to be changed from a state in which the detection temperature $\beta$ is low.

TABLE 1

| (Toff (° C.)) | | | |
|---|---|---|---|
| | ΔTn + 1 (° C./0.1 s) | | |
| Tn + 1 (° C.) | ΔTn + 1 ≤ 5 | 5 < ΔTn + 1 ≤ 7 | 7 < ΔTn + 1 |
| Tn + 1 ≤ 240 | 285 | 285 | 285 |
| 240 < Tn + 1 ≤ 250 | 285 | 285 | 260 |
| 250 < Tn + 1 | 285 | 270 | 260 |

Specific values mentioned in this embodiment are examples, and the present invention is not limited thereto.

For example, a threshold of the detection temperature gradient subjected to the control in this embodiment may also be changed between the cases of recording paper P with a basis weight of 105 g/m$^2$ and recording paper P with a basis weight of 300 g/m$^2$. With an increasing basis weight, an end portion of the film unit 310 is liable to separate from the pressing roller 302 at the fixing nip N. For that reason, with an increasing basis weight, the control in this embodiment may also be carried out at a greater value of the detection temperature gradient.

Further, the detection temperature threshold may also be changed depending on the basis weight and a paper (sheet) width.

Further, a threshold of the detection temperature gradient may also be changed depending on a detection temperature when the leading end of the recording paper P passes through the fixing nip N. When the temperature, at a timing when the recording paper P leading end passes through the fixing nip N, is high, a temperature difference until an error generates is small, and, therefore, even when the detection temperature gradient is small, the control can also be carried out.

The control in this embodiment will be described using a timing chart shown in FIG. 6. In FIG. 6, line (a) represents a fixing NIP-ON signal, which is 1 when the recording paper P exists in the fixing nip N, and which is 0 when the recording paper P does not exist in the fixing nip N, line (b) represents a detection temperature, which is always the temperature detected by the second thermistor 301*b*, line (c) represents a detection temperature gradient, which is calculated only when the recording paper P exists in the fixing nip N, as described with reference to the flowchart of FIG. 1, and line (d) represents a forced-heater-OFF temperature, of which default is set at 285 (° C.).

When the detection temperature gradient at line (c) is greater than 5 (° C./0.1 s) and the detection temperature at line (b) is greater than 250 (° C.), the CPU 203 changes the forced-heater-OFF temperature to 270 (° C.). When the detection temperature gradient at line (c) is greater than 7 (° C./0.1 s) and the detection temperature at line (b) is greater than 240 (° C.), the CPU 203 changes the forced-heater-OFF temperature to 260 (° C.). Further, for every time that the recording paper P passes through the fixing nip N, the CPU 203 returns the forced-heater-OFF temperature to 285 (° C.) (default).

In the control, when the forced-heater-OFF condition (temperature) is changed once, the setting is continued until the fed recording paper P passes through the fixing nip N. This is because continuous increase in detection temperature is prevented until the double fed paper passes through the fixing nip N.

In this embodiment, the setting of the forced-heater-OFF temperature was stepwisely changed by delimiting the detection temperature gradient stepwisely (for example, from 285 (° C.) to 270 (° C.)), but may also be continuously changed depending on an amount of the detection temperature gradient. For example, the setting of the forced-heater-OFF temperature may also be lowered by 1 (° C.) for every change of 1 (° C./0.1 s) in detection temperature gradient.

An effect of this embodiment will be described using FIG. 7. In FIG. 7, each of lines a and b shows a temperature change (progression) of the second thermistor 301*b* disposed in a non-sheet-passing-region in the case in which double fed paper (in this embodiment, multiply fed paper consisting of four sheets) having a legal (LGL) size (216 mm×356 mm, fed by short edge feeding) and a basis weight of 105 g/m$^2$ is passed through the fixing nip N, and c shows a temperature change of the second thermistor 301*b* in the case in which a single sheet of normal paper (the single LGL-size recording paper) is passed through the fixing nip N. In FIG. 7, a shows a conventional example ("CONN. EX.") in which the forced-heater-OFF temperature was uniformly set at 285 (° C.) irrespective of the detection temperature gradient. Further, the normal paper ("NORMAL") means recording paper that is singly fed without being doubly (multiply) fed.

As shown by a of FIG. 7, when the double fed paper is passed through the fixing nip N in control of the conventional example, the forced-heater-OFF temperature is set at 285 (° C.), and, therefore, the electrical power is continuously supplied to the heat generating elements 305*c* until the thermistor detection temperature of 285 (° C.) is detected. As a result, even when the thermistor detection temperature of 285 (° C.) and the electrical power is not supplied to the heat generating elements 305*e*, a longitudinal end portion of the film unit 310 is separated from the pressing roller 302 at the fixing nip N due to the influence of the heat accumulated in the fixing device 111 (thermistors, heat generating elements, and the like) and the double fed paper. For that reason, the heat is not dissipated toward the pressing roller 302 side, and the detection temperature of the second thermistor 301*b* increases up to an error detection temperature of 297 (° C.), so that an error generates.

On the other hand, as shown by b of FIG. 7, when the double fed paper is passed through the fixing nip N in the control of this embodiment, the detection temperature gradient of the second thermistor 301*b* is 6 (° C./0.1 s), and, therefore, the forced-heater-OFF temperature is changed to 270 (° C.). When the thermistor detection temperature exceeds the forced-heater-OFF temperature, the heater 305 is turned off (i.e., the supplied electrical supply is made zero).

For that reason, even due to the influence of the heat accumulated in the fixing device 111 (thermistors, heat generating elements, and the like) and the double fed paper, the thermistor detection temperature does not reach the error detection temperature of 297 (° C.), so that the error does not generate.

Further, in the case of the normal paper as shown by c of FIG. 7, the detection temperature gradient is low, even when the forced-heater-OFF temperature is 285 (° C.), the thermistor detection temperature does not reach the error detection temperature of 297 (° C.).

In the case in which the normal paper is passed through the fixing nip N, the detection temperature gradient does not increase. In the case in which the double fed paper is passed through the fixing nip N, the longitudinal end portion of the film unit 310 is separated from the pressing roller 302 at the fixing nip N, and, therefore, the detection temperature gradient increases.

Further, in the case in which the normal paper is passed through the fixing nip N, the detection temperature of the second thermistor 301*b* disposed in the non-sheet-passing-region does not reach the neighborhood of the error detection temperature.

For that reason, in the case in which the recording paper P falling within a specification is passed through the fixing nip, erroneous detection can be prevented by changing the control on the basis of the detection temperature gradient and the detection temperature, and in the case in which the detection temperature does not drastically increase up to the error temperature, the energization to the heater 305 is not forcedly turned off until the detection temperature reaches high temperatures (for example, 285 (° C.)). As a result, it is possible to suppress a lowering in temperature at the fixing nip N during normal operation. Further, for example, in the case in which recording paper P with a certain thickness and out of the specification, such as the double fed paper, is passed through the fixing nip N, by changing the control on the basis of the detection temperature gradient and the detection temperature, the energization to the heater 305 can be forcedly turned off in an earlier stage (for example, at 270 (° C.)). As a result, it is possible to prevent generation of the error.

Consequently, it is possible to suppress temperature rise of the heater 305 up to the error temperature at which there is a liability of generation of breakage and deterioration of constituent members of the fixing device 111.

In this embodiment, the second thermistor 301*b* disposed in the non-sheet-passing-region was described, but, in addition, the first thermistor 301*a* may also be subjected to similar control. When such a constitution is employed, for example, even in the case in which a user sets sheets by shifting the sheets to one side and causes the image forming apparatus 100 to feed the sheets through the fixing nip N and thus, the first thermistor 301*a* disposed at the central portion is positioned in the non-sheet-passing-region, erroneous detection is prevented, so that generation of the high temperature error when the double fed paper is fed through the fixing nip N can be prevented.

Further, when the detection temperature increases up to the error temperature, the operation of the image forming apparatus 100 stops due to the high temperature error, so that the user cannot use the image forming apparatus 100 until a high temperature error state is eliminated by a service person, or the like. That is, the error temperature is such a temperature that execution of the image forming operation is prohibited by the controller 203 until the error is eliminated by the service person. Accordingly, a degree of the generation of the high temperature error can be suppressed by the control in this embodiment. Therefore, when the high temperature error generates, it is possible to reduce a frequency of service person call by the user to eliminate the error. Therefore, it is possible to reduce a liability that productivity by the user is impaired.

In this embodiment, a single heater is used as an example, but a plurality of heaters may also be used. For example, the case in which a main heater (for principally heating a longitudinal central portion and for weakly heating longitudinal end portions) and a sub-heater (for principally heating a longitudinal end portion and for weakly heating the longitudinal central portion) are used in combination exists. Also, in such a case, the above-described "forced-heater-OFF" refers to turning-off of both the main heater and the sub-heater.

As regards the temperature corresponding to the non-sheet-passing-portion (non-sheet-passing-region) provided for carrying out the control in which the electrical power supply from the triac 200 to the heater 305 is stopped, a plurality of temperatures can be provided depending on the detection temperature and the detection temperature gradient, which are detected by the second thermistor 301*b*. Further, depending on the kind of the recording paper P used, it is possible to change a set value of the detection temperature gradient for carrying out the control in which the electrical power supply from the triac 200 to the heater 305 is stopped.

Further, depending on the detection temperature detected by the second thermistor 301*b*, when the leading end of the fed recording paper P passes through the fixing nip N, the set value of the detection temperature gradient for carrying out the control in which the electrical power supply from the triac 200 to the heater 305 is stopped can be changed.

Embodiment 2

In this embodiment, in addition to the forced-heater-OFF control of the heater 305 in Embodiment 1, control in which a maximum amount of electrical power supplied to the heater 305 is used in combination. As a result, the generation of the error can be prevented with high reliability when the double fed paper is passed through the fixing nip N.

Image Forming Apparatus and Fixing Device

In this embodiment, a constitution of an image forming apparatus 100 and a constitution of a fixing device 111 are the same as those in Embodiment 1, and, therefore, will be omitted from redundant description.

Double (Multi) Feed Detection of Recording Paper and Device Control

Control in this embodiment will be described using a flowchart of FIG. 8. In FIG. 8, control in steps S01 to S09 are the same as the control in steps S01 to S09 of the flowchart of FIG. 1 in Embodiment 1, and, therefore, will be omitted from redundant description.

In step S09, the CPU 203 discriminates whether or not the detection temperature gradient (temperature difference) $\Delta Tn+1$ is greater than $\alpha 1$ and is greater than $\beta 1$.

When a result of the discrimination is correct (YES), the CPU 203 sets a forced-heater-OFF temperature at Toff1 (° C.) and sets a maximum usable power value at Wmax (W) (step S10). When the result of the discrimination is not correct (NO), the sequence goes to step S11.

Forced-heater-OFF control refers to, as described in Embodiment 1, the control in which, when the second thermistor 301*b* detects the forced-heater-OFF temperature, the amount of electrical power supply to the heater 305 is made zero.

In step S11, the CPU 203 discriminates whether or not the detection temperature gradient (temperature difference) $\Delta Tn+1$ is greater than $\alpha 2<\alpha 1$ and is greater than $\beta 2>\beta 1$ (step S11). When a result of the discrimination is correct (YES), the CPU 203 sets the forced-heater-OFF temperature at Toff2 (° C.) (>Toff1 (° C.)) and sets the maximum usable power value at Wmax2 (W) (>Wmax1 (W)) (step S12). When the result of the discrimination is not correct (NO), the CPU 203 sets the forced-heater-OFF temperature at Toff3 (° C.) (>Toff2 (° C.)) and sets the maximum usable power value at Wmax3 (W) (>Wmax2 (W)) (step S13).

Next, the CPU 203 discriminates whether or not a trailing end of the recording paper P passed through the fixing nip N (step S14).

The CPU 203 discriminates whether or not the heater 305 should be forcedly turned off using, as an actual forced-heater-OFF temperature, a lowest temperature of forced-heater-OFF temperatures set during passing of a single recording paper P through the fixing nip N. That is, when the trailing end of the recording paper P does not pass through the fixing nip N, the CPU 203 employs the forced-heater-OFF temperature in the following manner. Of the forced-heater-OFF temperatures (Toff1, Toff2, and Toff3) set from entrance of a leading end of the recording paper P into the fixing nip N until the discrimination of step S14 is made, the lowest temperature (Toff(min)) is employed as the actual forced-heater-OFF temperature (Toff) (step S15).

Further, the CPU 203 sets, at an actual maximum usable power value (Wmax), the lowest maximum usable power value (Wmax (min)) of maximum usable power values set in a period from when the leading end of the recording paper P enters the fixing nip N until the discrimination of step S14 is made (step S15). The CPU 203 sets, as the actual maximum usable power value, the lowest maximum usable power value of the maximum usable power values set during passing of a single recording paper P through the fixing nip N. That is, when the trailing end of the recording paper P does not pass through the fixing nip N, the CPU 203 employs the following maximum usable power value as the actual maximum usable power value. Of the maximum usable power values (Wmax1, Wmax2, and Wmax 3) set in the period from when the leading end of the recording paper P enters the fixing nip N until the discrimination of step S14 is made, the lowest maximum usable power value is employed as the actual maximum usable power value.

For example, before the trailing end of the recording paper P passes through the fixing nip N, when the maximum usable power values set in steps S09 to S13 are Wmax1 and Wmax2, the following operation is performed. That is, in the period until the recording paper P passes through the fixing nip N, in step S15, the actual maximum usable power value is continuously set at Wmax1 (set in step S10) (step S15).

The CPU 203 controls the electrical power supply to the heater 305 within a range of the maximum usable power value set in step S15.

Next, the CPU 203 discriminates whether or not the thermistor detection temperature Tn+1 read in the last step S07 exceeds the actual forced-heater-OFF temperature in step S15 (step S18). When the thermistor detection temperature Tn+1 read in the last step S07 exceeds the actual forced-heater-OFF temperature set in step S15, the amount of the electrical power supplied to the heater 305 is made zero (forced-heater-OFF) (step S19), and the sequence goes to step S20.

On the other hand, when the thermistor detection temperature Tn+1 read in the last step S07 does not exceed the actual forced-heater-OFF temperature set in step S15, the CPU 203 continues temperature adjustment within the range of the maximum usable power value, and the sequence goes to step S20.

Then, the thermistor detection temperature Tn+1 read in the last step S07 is set at Tn (step S20). Then, after a lapse of 0.1 second from the reading of the detection temperature of the second thermistor 301*b* in the last step S07, the CPU 203 reads the detection temperature Tn+1 of the second thermistor 301*b* again (step S07). That is, the CPU 203 continuously detects the detection temperature gradient while reading the temperature of the second thermistor 301*b* every 0.1 second.

When the trailing end of the recording paper P passes through the fixing nip N, the CPU 203 sets the forced-heater-OFF temperature at Toff3 (° C.), which is a default and sets the maximum usable power value at Wmax3 (W), which is a default (step S16). In step S17, the CPU 203 discriminates whether or not the print job is a print job (JOB) of a plurality of sheets and subsequent recording paper P comes to the fixing nip N. When the subsequent recording paper P comes to the fixing nip N, the sequence returns to step S04.

There is a possibility that first sheets are double fed paper and a subsequent sheet is not the double fed paper, and, therefore, in step S16, the forced-heater-OFF temperature was returned to the default Toff3 (° C.) and the maximum usable power value was returned to the default Wmax3 (W).

In step S17, when the job is ended, the sequence of this control is ended.

Parameters n, α1, α2, β1, β2, Toff1, Toff2, Toff3, Wmax1, Wmax2, and Wmax3 in this control are summarized in Table 2 appearing hereafter.

In Table 2, n=0.1 (s), α1=7 (° C./0.1 s), α2=5 (° C./0.1 s), (31=240 (° C.), (32=250 (° C.), Toff1=260 (° C.), Toff2=270 (° C.), Toff3=285 (° C.), Wmax1=700 (W), Wmax2=900 (W), and Wmax3=1200 (W).

This setting was made since, when a value of the detection temperature gradient α is large, the forced-heater-OFF temperature and the maximum usable power value are required to be changed from a state in which the detection temperature β is low.

TABLE 2

| (Toff (° C.)/Wmax (W)) | | | |
|---|---|---|---|
| | ΔTn + 1 (° C./0.1 s) | | |
| Tn + 1 (° C.) | ΔTn + 1 ≤ 5 | 5 < ΔTn + 1 ≤ 7 | 7 < ΔTn + 1 |
| Tn + 1 ≤ 240 | 285/1200 | 285/1200 | 285/1200 |
| 240 < Tn + 1 ≤ 250 | 285/1200 | 285/1200 | 260/700 |
| 250 < Tn + 1 | 285/1200 | 270/900 | 260/700 |

In this embodiment, the above-described parameters were used, but the parameters may also be appropriately changed depending on product specification.

For example, a threshold of the detection temperature gradient subjected to the control in this embodiment may also be changed between the cases of recording paper P with a basis weight of 105 g/m$^2$ and recording paper P with a basis weight of 300 g/m$^2$. With an increasing basis weight, an end portion of the film unit 310 is liable to separate from an end portion of the pressing roller 302 at the fixing nip N. For that reason, with an increasing basis weight, the control in this embodiment may also be carried out at a greater value of the detection temperature gradient. Further, the detection temperature threshold may also be changed depending on the basis weight and a paper (sheet) width.

Further, a threshold of the detection temperature gradient may also be changed depending on a detection temperature when the leading end of the recording paper P (recording material) passes through the fixing nip N. When the temperature at a timing when the recording paper leading end passes through the fixing nip N is high, a temperature difference until an error generates is small, and, therefore, even when the detection temperature gradient is small, the control can also be carried out.

The control in this embodiment will be described using a timing chart shown in FIG. 9. In FIG. 9, lines (a), (b), and (c) are the same as those in the timing chart shown in FIG. 6 in Embodiment 1, and, therefore, will be omitted from redundant description. In FIG. 9, line (d) represents a forced-heater-OFF temperature, of which default is set at 285 (° C.), and line (e) represents a maximum usable power value, of which default is set at 1200 (W).

When the detection temperature gradient at line (c) is greater than 5 (° C./0.1 s) and the detection temperature at line (b) is greater than 250 (° C.), the CPU 203 changes the forced-heater-OFF temperature to 270 (° C.) and changes the maximum usable power value to 900 (W). When the detection temperature gradient at line (c) is greater than 7 (° C./0.1 s) and the detection temperature at line (b) is greater than 240 (° C.), the CPU 203 changes the forced-heater-OFF temperature to 260 (° C.) and changes the maximum usable power value to 700 (W). Further, every time when the recording paper P passes through the fixing nip N, the CPU 203 returns the forced-heater-OFF temperature to 285 (° C.) (default) and returns the maximum usable power value to 1200 (W) (default).

In the control, when the condition is changed once, the setting is continued until the fed recording paper passes through the fixing nip N. This is because a continuous increase in detection temperature is prevented until the double fed paper passes through the fixing nip N.

In the fixing device 111 of this embodiment, the heater 305 is controlled by wave-number control with 12 half-waves as one cyclic period. The control is carried out by switching the energization to the heater every half-wave unit. For example, in a case in which the heater 305 is continuously turned on throughout the period of the 12 half-waves, the supplied electrical power is 1200 (W).

In this embodiment, the wave number at which the heater 305 can be turned on is controlled depending on the detection temperature gradient and the detection temperature. For example, in a case in which the maximum usable power value Wmax is 1200 (W), the wave number at which the heater can be turned on is 12 at the maximum. In a case in which the maximum usable power value Vmax is 900 (W), the control condition is changed so that the wave number at which the heater can be turned on is 9 at the maximum. In a case in which the maximum usable power value Wmax is 700 (W), the control condition is changed so that the wave number at which the heater can be turned on is 7 at the maximum.

In this embodiment, when predetermined conditions are satisfied, the forced-heater-OFF temperature Toff and the maximum usable power value Wmax were stepwisely changed (for example, from 285 (° C.) to 270 (° C.) for Toff and from 1200 (W) to 900 (W) for Wmax), but may also be continuously changed depending on an amount of the detection temperature gradient. For example, the forced-heater-OFF temperature Toff may also be lowered by 1 (° C.) for every change of 1 (° C./0.1 s) in detection temperature gradient, and the maximum usable power value Wmax may also be lowered by 100 (W) for every change of 1 (° C./0.1 s) in detection temperature gradient.

By carrying out the control in this embodiment, when the recording paper P is discriminated as being the double fed paper, the forced-heater-OFF temperature and the maximum usable power value are changed, and, therefore, the thermistor detection temperature does not reach the error temperature of 297 (° C.), so that the error does not generate. On the other hand, in a case in which the normal paper is passed through the fixing nip, a high temperature gradient is not detected in a high-temperature region, and, therefore, the control in this embodiment is not required to be carried out and there is no problem.

By changing the control condition on the basis of the detection temperature gradient and the detection temperature, an effect similar to the effect of Embodiment 1 can be obtained. Specifically, in a case in which the recording paper P within the specification is passed through the fixing nip N, erroneous detection is prevented, so that it is possible to prevent generation of an error when the double fed paper is passed through the fixing nip N.

Consequently, it is possible to suppress temperature rise of the heater 305 up to the error temperature at which there is a liability of generation of breakage and deterioration of constituent members of the fixing device 111.

In this embodiment, the second thermistor 301*b* disposed in the non-sheet-passing-region was described, but, in addition, the first thermistor 301*a* may be subjected to similar control. When such a constitution is employed, for example, even in a case in which a user sets sheets by shifting the sheets to one side and causes the image forming apparatus 100 to feed the sheets through the fixing nip N and thus, the first thermistor 301*a* disposed at the central portion is positioned in the non-sheet-passing-region, erroneous detection is prevented, so that generation of the high temperature error when the double fed paper is fed through the fixing nip N can be prevented.

Further, when the detection temperature increases up to the error temperature, the operation of the image forming apparatus 100 stops due to the high temperature error, so that the user cannot use the image forming apparatus 100 until a high temperature error state is eliminated by a service person, or the like. That is, the error temperature is such a temperature that execution of the image forming operation is prohibited by the controller until the error is eliminated by the service person. Accordingly, a degree of the generation of the high temperature error can be suppressed by the control in this embodiment. Therefore, when the high temperature error generates, it is possible to reduce a frequency of service person call by the user to eliminate the error. Therefore, it is possible to reduce a liability that productivity by the user is impaired.

As regards the temperature corresponding to the non-sheet-passing-portion (non-sheet-passing-region) provided for carrying out the control in which a maximum value of the electrical power supply from the triac 200 to the heater 305 is changed, a plurality of temperatures can be provided depending on the detection temperature and the detection temperature gradient with time, which are detected by the second thermistor 301*b*. Further, depending on the kind of the recording paper P used, it is possible to change a set value of the detection temperature gradient for carrying out the control in which the maximum value of the electrical power supply from the triac 200 to the heater 305 is changed.

Further, depending on the detection temperature detected by the second thermistor 301*b* when the leading end of the fed recording paper passes through the fixing nip N, the set value of the detection temperature gradient for carrying out the control, in which the maximum value of the electrical power supply from the triac 200 to the heater 305 is changed, can be changed. Further, the maximum value of the electrical power supply from the triac 200 to the heater 305 can be changed so that the gradient of the detection temperature detected by the second thermistor 301*b* is not more than a predetermined value.

Reference Embodiment

In this reference embodiment, the controller 203 changes the maximum value of the electrical power supply from the triac 200 to a heater depending on the detection temperature detected by the second thermistor 301*b* and the temperature difference gradient with time.

Image Forming Apparatus

In this reference embodiment, a constitution of an image forming apparatus 100 is the same as the printer of FIG. 2 in Embodiment 1, and, therefore, will be omitted from redundant description.

Fixing Device (1) Device Structure

FIG. 10 is a schematic sectional view showing a structure of a principal part of a fixing device 111 in this embodiment. Also, this fixing device 111 is a so-called tension-less fixing device of a film (belt) heating type and a pressing roller driving type, similarly as the fixing device 111 in Embodiment 1. A difference from the fixing device 111 in Embodiment 1 is a constitution in which a halogen heater (halogen lamp) 305A is used as the heating member, and in which first and second thermistors 301*a* and 301*b* as the temperature detecting elements detect an inner surface temperature of the film 303. In the following description, this different constitution will be principally described, and common constituent members or portions are represented by the same reference numerals or symbols, and will be omitted from redundant description.

In the film unit 310, an elongated bar-like halogen heater 305A extending in a film width direction is provided at an inner hollow portion of a cylindrical film 303 so that one end portion and the other end portion thereof are supported between flange members on one end side and the other end side of the film unit 310. Further, between the halogen heater 305A and the stay 308, a radiant heat reflecting mirror 312 extending along a longitudinal direction of the halogen heater 305A is fixedly provided on the stay 308.

The film unit 310 includes a nip-forming member consisting of a slidable member 313*a* and a holding member 313*b*. The slidable member 313*a* and the holding member 313*b* correspond to the heater 303 and the holder 304, respectively, of the fixing device 111 in Embodiment 1. The stay 308 backs up the nip-forming member 313 disposed inside the film 303. The slidable member 313*a* and the holding member 313*b* constituting the nip-forming member 313 are heat-insulating members of a heat-resistant resin material, or the like.

From a viewpoint of energy saving, as a material of these members 313*a* and 313*b*, a material having a small degree of heat conduction to the stay 308 may desirably be used, and, for example, a heat-resistant resin material, such as heat-resistant glass, polycarbonate, or a liquid crystal polymer may be used.

The slidable member 313*a* of the nip-forming member 313 is positioned correspondingly to a film inner surface at the nip N in a state in which the nip N is formed between the film 303 and the pressing roller 302.

The first thermistor 301*a*, which is a temperature detecting element for detecting and adjusting the temperature of the film 303 in the sheet-passing-region, and the second thermistor 301*b*, which is a thickness detecting element for detecting double feed of the recording material P, are disposed on the slidable member 313*a* of the nip-forming member in this reference embodiment.

FIG. 11 shows a state of an arrangement of the thermistors 301*a* and 301*b* and the sliding member 313*a*. The sliding member 313*a* is provided with first and second cut holes 313*c* and 313*d* formed at a longitudinal central position and at a position of 115 mm apart from the central position toward the other end side, respectively. The first and second thermistors 301*a* and 301*b* are engaged in the cut holes 313*c* and 313*d*, respectively. A spring (not shown) is provided between the first thermistor 301*a* and the holding member 313*b* of the nip-forming member 313 and between the second thermistor 301*b* and the holding member 313*b* of the nip-forming member 313.

In a state in which the film unit 310 is pressed against the pressing roller 302 by a pressing mechanism and thus, the fixing nip N is formed between the film 303 and the pressing roller 302, an urging force of the spring is exerted on each of the first and second thermistors 301*a* and 301*b*. For that reason, the first and second thermistors 301*a* and 301*b* have a function of detecting the temperature of the inner surface of the belt (film) 303 in elastic contact with the film inner surface in the nip N.

(3) Fixing Operation

The controller 203 causes, at predetermined control timing in an execution sequence of a print job, the pressing mechanism in a pressure-released state to perform a pressing operation, so that the nip N is formed between the film 303 and the pressing roller 302, similarly as in the fixing device 111 of Embodiment 1. Then, the controller 203 actuates the motor M, so that the pressing roller 302 is rotationally driven at a predetermined peripheral speed in the counterclockwise direction of an arrow Y.

The pressing roller 302 is rotationally driven, whereby a rotational force acts on the film 303 by a frictional force between the surface of the pressing roller 302 and the surface of the film 303 in the nip N. For that reason, the film 303 is rotated by the rotational drive of the pressing roller 302 at a peripheral speed substantially equal to the peripheral speed of the pressing roller 302 in the clockwise direction of an arrow X along an outer peripheral surface of the nip-forming member 313 while sliding with the slidable member 313*a* of the nip-forming member 313 in intimate contact with the nip-forming member 313 at an inner peripheral surface thereof. The nip-forming member 313 has a semicircular shape in cross section and has a function of regulating a rotational orbit (locus) of the film 303.

Together with the rotational drive of the pressing roller 302, electrical power is supplied through an energization path (not shown) to the halogen heater 305A from a triac (energizing portion) 200 controlled by the controller 203. As a result, the halogen heater 305A is turned on over an entire region having an effective heat generating width. By this turning-on of the halogen heater 305A, the inner surface of the film 303 is irradiated principally in a range of an angle α with respect to a circumferential direction with direct light of the radiation heat and reflected light reflected by the reflecting mirror 312. As a result, all of a circumferential portion of the rotating film 303 is heated.

A heating temperature by the radiation heat of the halogen heater 305A is detected by the first thermistor 301*a* disposed in a region having a passing region width Wmin of the film 303 with respect to a smallest width-size recording paper P and detection temperature information is input to the CPU 203. The CPU 203 performs adjustment of the film inner surface temperature so that the film surface temperature is a predetermined target temperature (fixing temperature), on the basis of the detection temperature information. That is, the CPU 203 controls, through the wave-number control, as described later, the electrical power supply from the energizing portion 200 to the halogen heater 305A so that the film surface temperature becomes the predetermined target temperature.

Then, in a state in which the pressing roller 302 is rotationally driven and the surface temperature of the film 303 is increased up to the predetermined target temperature by the halogen heater 305A and is temperature-controlled at the predetermined target temperature, the recording paper P, on which the unfixed toner image t is formed, is guided into the nip N of the fixing device 111. In a process in which the recording paper P is nipped and fed through the nip N, heat of the film 303 is imparted to the recording paper P. The unfixed toner image t is melted by the heat of the film 303 and is fixed as a fixed toner image to on the recording paper P by pressure exerted on the nip N.

Double (Multi) Feed Detection of Recording Paper and Device Control

Control in this reference embodiment will be described using a flowchart of FIG. 12. In FIG. 12, control in steps S01 to S09 are the same as the control in steps S01 to S09 of the flowchart of FIG. 1 in Embodiment 1, and, therefore, will be omitted from redundant description.

In step S09, the CPU 203 discriminates whether or not the detection temperature gradient (temperature difference) ΔTn+1 is greater than α1 and is greater than β1.

When a result of the discrimination is correct (YES), the CPU 203 sets a maximum usable power value at Wmax (W) (step S10). When the result of the discrimination is not correct (NO), the sequence goes to step S11.

In step S11, the CPU 203 discriminates whether or not the detection temperature gradient (through difference) ΔTn+1 is greater than α2<al and is greater than β2>β1 (step S11). When a result of the discrimination is correct (YES), the CPU 203 sets the maximum usable power value at Wmax2 (W) (>Wmax1 (W)) (step S12). When the result of the discrimination is not correct (NO), the CPU 203 sets the maximum usable power value at Wmax3 (W) (>Wmax2 (W)) (step S13).

Next, the CPU 203 discriminates whether or not a trailing end of the recording paper P passed through the fixing nip N (step S14).

Further, the CPU 203 sets, as an actual maximum usable power value (Wmax), the lowest maximum usable power value (Wmax (min)) of maximum usable power values set in a period from when the leading end of the recording paper P enters the fixing nip N until the discrimination of step S14 is made (step S15). The CPU 203 sets, as the actual maximum usable power value, the lowest maximum usable power value of the maximum usable power values set during passing of a single sheet of recording paper P through the fixing nip N. That is, when the trailing end of the recording paper P does not pass through the fixing nip N, the CPU 203 employs the following maximum usable power value as the actual maximum usable power value. Of the maximum usable power values (Wmax1, Wmax2, and Wmax 3) set in the period from when the leading end of the recording paper P enters the image form nip N until the discrimination of step S14 is made, the lowest maximum usable power value is employed as the actual maximum usable power value.

For example, before the trailing end of the recording paper P passes through the fixing nip N, when the maximum usable power values set in steps S09 to S13 are Wmax1 and Wmax2, the following operation is performed. That is, in the period until the recording paper P passes through the fixing nip N, in step S15, the actual maximum usable power value is continuously set at Wmax1 (set in step S10) (step S15).

The CPU 203 controls the electrical power supply to the heater 305 within a range of the maximum usable power value set in step S15.

Then, the thermistor detection temperature Tn+1 read in the last step S07 is set at Tn (step S18). Then, after a lapse of 0.1 second from the reading of the detection temperature of the second thermistor 301*b* in the last step S07, the CPU 203 reads the detection temperature Tn+1 of the second thermistor 301*b* again (step S07). That is, the CPU 203 continuously detects the detection temperature gradient while reading the temperature of the second thermistor 301*b* every 0.1 second.

When the trailing end of the recording paper P passes through the fixing nip N, the CPU 203 sets the maximum usable power value at Wmax3 (W), which is a default (step S16). In step S17, the CPU 203 discriminates whether or not the print job is a print job (JOB) of a plurality of sheets, and subsequent recording paper P comes to the fixing nip N. When the subsequent recording paper P comes to the fixing nip N, the sequence returns to step S04.

There is a possibility that first sheets are double fed paper and a subsequent sheet is not the double fed paper, and, therefore, in step S16, the maximum usable power value was returned to the default Wmax3 (W).

In step S17, when the job is ended, the sequence of this control is ended.

Parameters n, $\alpha1$, $\alpha2$, $\beta1$, $\beta2$, Wmax1, Wmax2, and Wmax3 in this control are summarized in Table 3 appearing hereafter.

In Table 3, n=0.1 (s), $\alpha1$=7 (° C./0.1 s), $\alpha2$=5 (° C./0.1 s), ($\beta1$=240 (° C.), ($\beta2$=250 (° C.), Wmax1=700 (W), Wmax2=900 (W), and Wmax3=1200 (W).

This setting was made since, when a value of the detection temperature gradient $\alpha$ is large, the maximum usable power value is required to be changed from a state in which the detection temperature $\beta$ is low.

TABLE 3

| (Wmax (W)) | | | |
|---|---|---|---|
| | ΔTn + 1 (° C./0.1 s) | | |
| Tn + 1 (° C.) | ΔTn + 1 ≤ 5 | 5 < ΔTn + 1 ≤ 7 | 7 < ΔTn + 1 |
| Tn + 1 ≤ 240 | 1200 | 1200 | 1200 |
| 240 < Tn + 1 ≤ 250 | 1200 | 1200 | 700 |
| 250 < Tn + 1 | 1200 | 900 | 700 |

In this reference embodiment, the above-described parameters were used, but the parameters may also be appropriately changed depending on a product specification.

For example, a threshold of the detection temperature gradient subjected to the control in this embodiment may also be changed between the cases of recording paper P with a basis weight of 105 g/m$^2$ and recording paper with a basis weight of 300 g/m$^2$.

With an increasing basis weight, an end portion of the film unit 310 is liable to separate from an end portion of the pressing roller 302 at the fixing nip N. For that reason, with an increasing basis weight, the control in this embodiment may also be carried out at a greater value of the detection temperature gradient. Further, the detection temperature threshold may also be changed depending on the basis weight and a paper (sheet) width.

Further, a threshold of the detection temperature gradient may also be changed depending on a detection temperature when the leading end of the recording paper (recording material) passes through the fixing nip N. When the temperature at a timing when the recording paper leading end passes through the fixing nip N is high, a temperature difference until an error generates is small, and, therefore, even when the detection temperature gradient is small, the control can also be carried out.

The control in this embodiment will be described using a timing chart shown in FIG. 13. In FIG. 13, lines (a), (b) and (c) are the same as those in the timing chart shown in FIG. 6 in Embodiment 1, and, therefore, will be omitted from redundant description. In FIG. 13, line (d) represents a maximum usable power value, of which a default is set at 1200 (W).

When the detection temperature gradient at line (c) is greater than 5 (° C./0.1 s) and the detection temperature at line (b) is greater than 250 (° C.), the CPU 203 changes the maximum usable power value to 900 (W). When the detection temperature gradient at line (c) is greater than 7 (° C./0.1 s) and the detection temperature at line (b) is greater than 240 (° C.), the CPU 203 changes the maximum usable power value to 700 (W). Further, every time when the recording paper P passes through the fixing nip N, the CPU 203 returns the maximum usable power value to 1200 (W) (default).

In the control, when the maximum usable power value is changed once, the setting is continued until the fed recording paper passes through the fixing nip N. This is because continuous increase in detection temperature is prevented until the double fed paper passes through the fixing nip N.

In the fixing device 111 of this reference embodiment, the heater 305 is controlled by wave-number control with 12 half-waves as one cyclic period. The control is carried out by switching the energization to the heater every half-wave unit. For example, in a case in which the heater is continuously turned on throughout the period of the 12 half-waves, the supplied electrical power is 1200 (W).

In this reference embodiment, the wave number at which the heater 305 can be turned on is controlled depending on the detection temperature gradient and the detection temperature. For example, in a case in which the maximum usable power value Wmax is 1200 (W), the wave number at which the heater 305 can be turned on is 12 at the maximum. In a case in which the maximum usable power value Vmax is 900 (W), the control condition is changed so that the wave number at which the heater 305 can be turned on is 9 at the maximum. In a case in which the maximum usable power value Wmax is 700 (W), the control condition is changed so that the wave number at which the heater 305 can be turned on is 7 at the maximum.

In this reference embodiment, when predetermined conditions are satisfied, the maximum usable power value Wmax was stepwisely changed (for example, from 1200 (W) to 900 (W)), but the maximum usable power value Wmax may also be continuously changed depending on an amount of the detection temperature gradient. For example, the maximum usable power value Wmax may be lowered by 100 (W) for every change of 1 (° C./0.1 s) in detection temperature gradient. By carrying out the control in this embodiment, when the recording paper is discriminated as being the double fed paper, the maximum usable power value is changed, and, therefore, the thermistor detection temperature does not reach the error temperature of 297 (° C.), so that a frequency of generation of the error can be reduced.

Also in this reference embodiment, in a case in which the double fed paper is fed through the fixing nip N, the frequency of generation of the error can be reduced, but, when the heater 305 is not turned off, there is a liability that the heater is continuously turned on with maximum usable electrical power in order to increase the sheet-passing-portion temperature, for example. Accordingly, compared with this reference embodiment, the above-described Embodiments 1 and 2 are preferred embodiments.

In this reference embodiment, the second thermistor 301*b* disposed in the non-sheet-passing-region was described, but, in addition, the first thermistor 301*a* may also be subjected to similar control. When such a constitution is employed, for example, even in a case in which a user sets sheets by shifting the sheets to one side and causes the image forming apparatus 100 to feed the sheets through the fixing nip N and thus, the first thermistor 301*a* disposed at the central portion is positioned in the non-sheet-passing-region, a similar effect can be achieved.

As regards the temperature corresponding to the non-sheet-passing-portion (non-sheet-passing-region) provided for carrying out the control in which a maximum value of the electrical power supply from the triac 200 to the halogen heater 305A is changed, a plurality of temperatures can be provided depending on the detection temperature and the detection temperature gradient with time, which are detected by the second thermistor 301*b*. Further, depending on the kind of the recording paper P used, it is possible to change a set value of the detection temperature gradient for carrying out the control in which the maximum value of the electrical power supply from the triac 200 to the halogen heater 305A is changed.

Further, depending on the detection temperature detected by the second thermistor 301*b*, when the leading end of the fed recording paper passes through the fixing nip N, the set value of the detection temperature gradient for carrying out the control, in which the maximum value of the electrical power supply from the triac 200 to the halogen heater 305A is changed, can be changed. Further, the maximum value of the electrical power supply from the triac 200 to the halogen heater 305A can be changed so that the gradient of the detection temperature detected by the second thermistor 301*b* is not more than a predetermined value.

Embodiment 3

In this embodiment, the maximum usable power value is changed so that the state gradient becomes a certain value.

Image Forming Apparatus and Fixing Device

In this embodiment, a constitution of an image forming apparatus 100 and a constitution of a fixing device 111 are the same as those in Embodiment 1, and, therefore, will be omitted from redundant description.

Double (Multi) Feed Detection of Recording Paper and Device Control

Control in this embodiment will be described using a flowchart of FIG. 14. In FIG. 14, control in steps S01 to S09 are the same as the control in steps S01 to S09 of the flowchart of FIG. 1 in Embodiment 1, and, therefore, will be omitted from redundant description.

In step S09, the CPU 203 discriminates whether or not the detection temperature gradient (temperature difference) $\Delta Tn+1$ is greater than $\alpha 1$ and is greater than $\beta 1$.

When a result of the discrimination is correct (YES), the CPU 203 sets the maximum usable power value at Wmax (W)−50 (W), so that the detection temperature gradient is not more than $\alpha 1$ (step S10). When the result of the discrimination is not correct (NO), the CPU 203 sets the maximum usable power value at Wmax(n+1) (W)=Wmax (n), which is Wmax set prior to Wmax(n+1) (step S11).

Next, the CPU 203 discriminates whether or not a trailing end of the recording paper P passed through the fixing nip N (step S12).

When the trailing end of the recording paper P does not pass through the fixing nip N, the thermistor detection temperature Tn+1 read in the last step S07 is set at Tn (step S15). Then, after a lapse of 0.1 second from the reading of the detection temperature of the second thermistor 301*b* in the last step S07, the CPU 203 reads the detection temperature Tn+1 of the second thermistor 301*b* again (step S07). That is, the CPU 203 continuously detects the detection temperature gradient while reading the temperature of the second thermistor 301*b* every 0.1 second.

When the trailing end of the recording paper P passes through the fixing nip N, the CPU 203 returns the setting of the maximum usable power value Wmax(0) to the maximum usable power value Wmax(ini) as a default setting (step S13).

In step S14, the CPU 203 discriminates whether or not the print job is a print job (JOB) of a plurality of sheets and a subsequent recording paper P comes to the fixing nip N. When the subsequent recording paper P comes to the fixing nip N, the sequence returns to step S04.

There is a possibility that first sheets are double fed paper and a subsequent sheet is not the double fed paper, and, therefore, in step S13, the maximum usable power value Wmax(0) was returned to the maximum usable power value Wmax(ini) as the default setting.

In step S17, when the job is ended, the sequence of this control is ended.

Parameters n, $\alpha 1$, $\beta 1$, and Wmax(ini) are as follows.

That is, n=0.1 (s), $\alpha 1$=7 (° C./0.1 s), $\beta 1$=250 (° C.), and Wmax(ini)=1200 W were set.

In this embodiment, the above-described parameters were used, but may also be appropriately changed depending on product specification.

For example, a threshold of the detection temperature gradient subjected to the control in this embodiment may also be changed between the cases of recording paper with a basis weight of 105 g/m$^2$ and recording paper with a basis weight of 300 g/m$^2$. With an increasing basis weight, an end portion of the film unit 310 is liable to separate from an end portion of the pressing roller 302 at the fixing nip N. For that reason, with an increasing basis weight, the control in this embodiment may also be carried out at a greater value of the detection temperature gradient. Further, the detection temperature threshold may also be changed depending on the basis weight and a paper (sheet) width.

Further, a threshold of the detection temperature gradient may also be changed depending on a detection temperature at a timing when the leading end of the recording paper (recording material) passes through the fixing nip N. When the temperature when the recording paper leading end passes through the fixing nip N is high, a temperature difference until an error generates is small, and, therefore, even when the detection temperature gradient is small, the control can also be carried out.

The control in this embodiment will be described using a timing chart shown in FIG. 15. In FIG. 15, line (a) represents a fixing NIP-ON signal, which is 1 when the recording paper P exists in the fixing nip N, and which is 0 when the recording paper P does not exist in the fixing nip N, line (b) represents a detection temperature, which is always the temperature detected by the second thermistor 301*b*, line (c) represents a detection temperature gradient, which is calculated only when the recording paper P exists in the fixing nip N, as described with reference to the flowchart of FIG. 1, and line (d) represents the maximum usable power value, of which a default is set at 1200 (W).

When the detection temperature gradient at line (c) is greater than 5 (° C./0.1 s) and the detection temperature at line (b) is greater than 250 (° C.), the CPU 203 gradually decreases the maximum usable power value from the default of 1200 (W) with a decrement of 50 (W), so that the detection temperature gradient becomes not more than 5 (° C./0.1 s). Further, for every time when the recording paper P passes through the fixing nip N, the CPU 203 returns the maximum usable power value to 1200 (W) (default).

In this embodiment, when predetermined conditions are satisfied, the maximum usable power value Wmax was stepwisely decreased every 50 (W), but the maximum usable power value Wmax may also be continuously changed depending on an amount of the detection temperature gradient.

By carrying out the control in this embodiment, when the recording paper P is discriminated as being the double fed paper, the control condition is changed, and, therefore, the thermistor detection temperature does not reach the error temperature of 297 (° C.), so that the error does not generate. On the other hand, in a case in which the normal paper is passed through the fixing nip N, a high temperature gradient is not detected in a high-temperature region, and, therefore, the control in this embodiment is not required to be carried out and there is no problem.

By changing the control condition on the basis of the detection temperature gradient and the detection temperature, an effect similar to the effects of other embodiments can be obtained. Specifically, in a case in which the recording paper P within the specification is passed through the fixing nip N, erroneous detection is prevented, so that it is possible to prevent generation of an error when the double fed paper is passed through the fixing nip N.

Consequently, it is possible to provide the image heating apparatus 111 (fixing device) and the image forming apparatus 100 that are capable of suppressing generation of breakage or deterioration of constituent members of the fixing device 111 with reliability.

In this embodiment, the second thermistor 301*b* disposed in the non-sheet-passing-region was described. Even in a case in which a user sets sheets by shifting the sheets to one side and causes the image forming apparatus 100 to feed the sheets through the fixing nip N and thus, the first thermistor 301*a* disposed at the central portion is positioned in the non-sheet-passing-region, the control is carried out similarly as in the case of the second thermistor 301*b* disposed in the non-sheet-passing-region. For that reason, erroneous detection is prevented.

Further, when the detection temperature increases up to the error temperature, the operation of the image forming apparatus 100 stops due to the high temperature error, so that the user cannot use the image forming apparatus 100 until a high temperature error state is eliminated by a service person, or the like. That is, the error temperature is such a temperature that execution of the image forming operation is prohibited by the controller until the error is eliminated by the service person. Accordingly, a degree of the generation of the high temperature error can be suppressed by the control in this embodiment. Therefore, when the high temperature error generates, it is possible to reduce a frequency of service person call by the user to eliminate the error. Therefore, it is possible to reduce a liability that productivity by the user is impaired.

OTHER EMBODIMENTS (1) In Embodiments 1 and 2, described above, a case in which the setting of the forced-heater-OFF temperature is changed on the basis of the detection temperature of the second thermistor 301*b* for detecting the temperature of the heater 305, and on the basis of the temperature rise rate per unit time of the detection temperature was described as an example. A constitution in which the steps of the control process in the above-described embodiments are carried out on the basis of a temperature of the film 303 detected by a temperature sensor (detecting portion), for detecting the temperature, provided outside a passing region width Wmin of the smallest-size recording paper and inside a maximum passing region width Wmax may, however, also be employed. This temperature sensor is, for example, a thermistor contacting an inner surface of the film 303.

(2) In the above description, the embodiments of the present invention were described, but numerical values of dimensions, conditions, and the like, mentioned in the above-described embodiments are examples, and, therefore, the present invention is not limited thereto. The numerical values can be appropriately selected within a range to which the present invention is applicable. For example, the steps of the control method, as in the above-described embodiments, may also be carried out using fixing devices of a roller fixing type and an induction heating (IH) fixing type.

(3) The film 303 in Embodiment 1 is not limited to that having a constitution in which an inner surface thereof is supported by the heater 305, and the film 303 is driven by the pressing roller 302. For example, the film 303 may also be of a unit type in which the film 303 is stretched and extended around a plurality of rollers, and is driven by either one of these rollers. From a viewpoint of low thermal conductivity, however, the constitutions as in Embodiments 1 and 2 may desirably be employed.

(4) The member forming the nip N in cooperation with the film 303 is not limited to a roller member, such as the pressing roller 302. For example, a pressing belt unit including a belt stretched and extended around a plurality of rollers may also be used.

(5) As the fixing device 111, the device for fixing the unfixed toner image t formed on the recording paper P by heating the toner image t was described as an example, but the present invention is not limited thereto. For example, a device for increasing a gloss (glossiness) of an image by heating and re-fixing a toner image temporarily fixed on the recording paper (also in this case, the device is referred to as the fixing device) may also be used. That is, for example, the fixing device 111 may also be a device for fixing the partly fixed toner image t on the recording paper P, or a device for subjecting the fixed image to to a heating process. Accordingly, the fixing device 111 may also be, for example, a surface heating device (apparatus) for adjusting a gloss or a surface property of an image.

(6) The image forming apparatus described using the printer 100 as an example is not limited to the image forming apparatus for forming the monochromatic image, and may also be an image forming apparatus for forming a color image. Further, the image forming apparatus can be carried out in various uses, such as a copying machine, a facsimile machine, and a multi-function machine having functions as these machines, by adding necessary device, equipment, and casing structure.

(7) In the above description, for convenience, treatment of the recording material (sheet) P was described using terms associated with paper (sheet), such as sheet (paper) passing, sheet feeding, sheet discharge, sheet-passing-portion, non-sheet-passing-portion, and the like, but the recording material P is not limited to the paper. The recording material P is a sheet-shaped recording medium (media) on which the toner image t is capable of being formed by the image forming apparatus. For example, regular or irregular recording media, such as plain paper, thin paper, thick paper, high-quality paper, coated paper, envelope, postcard, seal, resin sheet, OHP sheet, printing sheet, formatted paper, and the like, are cited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

an endless belt configured to heat a toner image on a recording material, while feeding the recording material through a nip;

a rotatable member configured to form the nip in cooperation with said endless belt;

a heater including a heat generating element configured to generate heat by energization, said heater being configured to heat said endless belt;

a detecting portion configured to detect a temperature of said heat generating element configured to heat a region outside of a minimum sheet passing region of said endless belt with respect to a longitudinal direction of said endless belt, wherein the minimum sheet passing region is a region of said endless belt in which, with respect to the longitudinal direction, a minimum-size recording material of recording materials to be fed to the nip passes through the region; and a controller configured to control a temperature, at which energization to said heater is turned off, depending on a detection temperature of said detecting portion, wherein, when a temperature rise rate per unit time of the detection temperature of said detecting portion is a first rise rate, said controller turns off the energization to said heater in response to the detection temperature reaching a first temperature, and, when the temperature rise rate per unit time is a second rise rate that is less than the first rise rate, said controller turns off the energization to said heater in response to the detection temperature reaching a second temperature that is greater than the first temperature.

2. The image heating apparatus according to claim 1, wherein, when the temperature rise rate per unit time is the first rise rate, said controller permits the energization to said heater until the detection temperature reaches the first temperature, and, when the temperature rise rate per unit time is the second rise rate, said controller permits the energization to said heater until the detection temperature reaches the second temperature.

3. The image heating apparatus according to claim 1, further comprising an image forming portion configured to form the toner image on the recording material, wherein, when the temperature rise rate per unit time is the first rise rate, in response to the detection temperature reaching the first temperature, said controller turns off the energization to said heater in a state in which continuation of an image forming operation by said image forming portion is detected, and, when the temperature rise rate per unit time is the second rise rate, in response to the detection temperature reaching the second temperature, said controller turns off the energization to said heater in the state in which continuation of the image forming operation by said image forming portion is detected.

4. The image heating apparatus according to claim 1, further comprising an image forming portion configured to form the toner image on the recording material, wherein the first temperature and the second temperature are less than a predetermined temperature, at which execution of an image forming operation by said image forming portion is prohibited.

5. The image heating apparatus according to claim 1, wherein said controller sets the temperature, at which the energization to said heater is turned off, at the first temperature when the temperature rise rate per unit time is the first rise rate, and sets the temperature, at which the energization to said heater is turned off, at the second temperature, and then turns off the energization to said heater, in response to that the detection temperature reaching the set temperature, and wherein, when the temperature, at which the energization to said heater is turned off, is set at the first temperature during passing of the recording material through the nip, said controller sets the temperature, at which the energization to said heater is turned off, at a temperature that is greater than the first temperature in response to passing of a trailing end of the recording material through the nip.

6. The image heating apparatus according to claim 1, wherein said controller controls the temperature, at which the energization to said heater is turned off, depending on the detection temperature and the temperature rise rate per unit time, and wherein, when the detection temperature is a first detection temperature and the temperature rise rate is the first rise rate, said controller sets the temperature, at which the energization to said heater is turned off, at the first temperature, and, when the detection temperature is a second detection temperature that is less than the first detection temperature and the temperature rise rate per unit time is the first rise rate, said controller sets the temperature, at which the energization to said heater is turned off, at a third temperature that is greater than the first temperature.

7. The image heating apparatus according to claim 1, wherein, when the recording material with a first size, with respect to the longitudinal direction, in which the recording material is in non-contact with said endless belt at a position in which said detecting portion is provided with respect to the longitudinal direction, is fed through the nip, said controller turns off, when the temperature rise rate per unit time is the first rise rate, the energization to said heater in response to the detection temperature reaching the first temperature, and turns off, when the temperature rise rate per unit time is the second rise rate, the energization to said heater in response to the detection temperature reaching the second temperature.

8. The image heating apparatus according to claim 1, wherein, depending on the temperature rise rate per unit time, said controller limits an upper limit of electrical power supplied to said heater in a period until the energization to said heater is turned off.

9. The image heating apparatus according to claim 1, wherein, depending on the detection temperature and the temperature rise rate per unit time, said controller limits an upper limit of electrical power supplied to said heater in a period until the energization to said heater is turned off.

10. An image forming apparatus comprising:

an image forming portion configured to form a toner image on a recording material;

an endless belt configured to heat the toner image, formed on the recording material by said image forming portion, while feeding the recording material through a nip;

a rotatable member configured to form the nip in cooperation with said endless belt;

a heater including a heat generating element configured to generate heat by energization, said heater being configured to heat said endless belt;

a sensor configured to detect a temperature of said heat generating element configured to heat a region outside of a minimum sheet passing region of said endless belt with respect to a longitudinal direction of said endless belt, wherein the minimum sheet passing region is a region of said endless belt in which, with respect to the longitudinal direction, a minimum-size recording material of recording materials to be fed to the nip passes through the region;

a double feed detecting portion configured to detect feeding of a plurality of recording materials to the nip; and a controller configured to control a temperature, at which energization to said heater is turned off, depending on a detection result of said double feed detecting portion, wherein, when the feeding of the plurality of recording materials to the nip is detected by said double feed detecting portion, said controller turns off the energization to said heater in response to the detection temperature of said sensor reaching a first temperature, and, when the feeding of the plurality of recording materials to the nip is not detected by said double feed detecting portion, said controller turns off the energization to said heater in response to the detection temperature reaching a second temperature that is greater than the first temperature.

11. The image forming apparatus according to claim 10, wherein, when the feeding of the plurality of recording materials to the nip is detected by said double feed detecting portion, said controller permits the energization to said heater until the detection temperature reaches the first temperature, and, when the feeding of the plurality of recording materials to the nip is not detected by said double feed detecting portion, said controller permits the energization to said heater until the detection temperature reaches the second temperature.

12. The image forming apparatus according to claim 10, further comprising an image forming portion configured to form the toner image on the recording material, wherein, when the feeding of the plurality of recording materials to the nip is detected by said double feed detecting portion, in response to the detection temperature reaching the first temperature, said controller turns off the energization to said heater in a state in which continuation of an image forming operation by said image forming portion is detected, and, when the feeding of the plurality of recording materials to the nip is not detected by said double feed detecting portion, in response to the detection temperature reaching the second temperature, said controller turns off the energization to said heater in the state in which continuation of the image forming operation by said image forming portion is detected.

13. The image forming apparatus according to claim 10, further comprising an image forming portion configured to form the toner image on the recording material, wherein the first temperature and the second temperature are less than a predetermined temperature at which execution of an image forming operation by said image forming portion is prohibited.

14. The image forming apparatus according to claim 10, wherein, on the basis of an output of said sensor, said double feed detecting portion detects the feeding of the plurality of recording materials to the nip.

15. An image heating apparatus comprising:

an endless belt configured to heat a toner image on a recording material, while feeding the recording material through a nip;

a rotatable member configured to form the nip in cooperation with said endless belt;

a heater including a heat generating element configured to generate heat by energization, said heater being configured to heat said endless belt;

a detecting portion configured to detect a temperature of said endless belt in a region outside of a minimum sheet passing region of said endless belt with respect to a longitudinal direction of said endless belt, wherein the minimum sheet passing region is a region of said endless belt in which, with respect to the longitudinal direction, a minimum-size recording material of recording materials to be fed to the nip passes through the region; and a controller configured to control a temperature, at which energization to said heater is turned off, depending on the detection temperature of said detecting portion, wherein, when a temperature rise rate per unit time of the detection temperature of said detecting portion is a first rise rate, said controller turns off the energization to said heater in response to the detection temperature reaching a first temperature, and, when the temperature rise rate per unit time is a second rise rate that is less than the first rise rate, said controller turns off the energization to said heater in response to the detection temperature reaching a second temperature that is greater than the first temperature.

* * * * *